US011592194B2

(12) United States Patent
Kohavi et al.

(10) Patent No.: US 11,592,194 B2
(45) Date of Patent: Feb. 28, 2023

(54) PLANAR ELEMENT FOR FORMING HEAT EXCHANGER

(71) Applicant: WATERGEN LTD., Petach Tikva (IL)

(72) Inventors: Arye Kohavi, Newe Monosson (IL); Sharon Dulberg, Beer Sheva (IL)

(73) Assignee: WATERGEN LTD., Petach Tikva (IL)

( * ) Notice: Subject to any disclaimer, the term of this patent is extended or adjusted under 35 U.S.C. 154(b) by 0 days.

(21) Appl. No.: 16/868,560

(22) Filed: May 7, 2020

(65) Prior Publication Data

US 2020/0263345 A1 Aug. 20, 2020

Related U.S. Application Data

(63) Continuation of application No. 15/960,550, filed on Apr. 24, 2018, now abandoned, which is a (Continued)

(51) Int. Cl.
*F28D 9/00* (2006.01)
*F24F 3/14* (2006.01)
(Continued)

(52) U.S. Cl.
CPC ..... *F24F 3/1405* (2013.01); *D06F 58/20* (2013.01); *D06F 58/26* (2013.01); *F28D 1/0426* (2013.01);
(Continued)

(58) Field of Classification Search
CPC ..... F28F 3/086; F28D 1/0477; F28D 1/0641; F28D 1/0426; D06F 58/24
See application file for complete search history.

(56) References Cited

U.S. PATENT DOCUMENTS 2,154,481 A 4/1939 Vorkauf
3,509,639 A 5/1970 Fritz
(Continued)

FOREIGN PATENT DOCUMENTS

CN 101187486 5/2008
CN 201569092 9/2010
(Continued)

OTHER PUBLICATIONS

Palandre et al., "Comparison of Heat Pump Dryer and Mechanical Steam Compression Dryer", International Congress of Refrigeration, 8 pages, year 2003.

*Primary Examiner* — Nael N Babaa
(74) *Attorney, Agent, or Firm* — Pearl Cohen Zedek Latzer Baratz LLP

(57) ABSTRACT

Planar element adapted to form, when stacked with a plurality of other such elements, a heat exchanger, comprising an inlet region, a first zone adapted to direct flow from the inlet region towards a second zone, a second zone comprising at least one cutout in the plane of the planar element, adapted to accommodate a cooling core, a third zone, adapted to direct flow from the second zone towards an outlet region and an outlet region, the planar element comprising a first blockage protrusion disposed along a first group of said side edges, the first group comprising at least a side edge adjacent to said outlet region, and a second blockage protrusion disposed along a second group of said side edges, the second group comprising at least a side edge adjacent to said inlet region.

13 Claims, 18 Drawing Sheets

Related U.S. Application Data continuation of application No. 14/859,910, filed on Sep. 21, 2015, now Pat. No. 9,976,817, which is a continuation of application No. 13/834,857, filed on Mar. 15, 2013, now Pat. No. 9,140,396.

(51) Int. Cl.

| | |
|---|---|
| ***F28D 1/047*** | (2006.01) |
| ***F28F 1/32*** | (2006.01) |
| ***F28F 9/00*** | (2006.01) |
| ***F28D 1/04*** | (2006.01) |
| ***F28F 9/02*** | (2006.01) |
| ***F28D 7/08*** | (2006.01) |
| ***F28F 17/00*** | (2006.01) |
| ***D06F 58/20*** | (2006.01) |
| ***D06F 58/26*** | (2006.01) |
| ***F28F 3/08*** | (2006.01) |
| *F28D 21/00* | (2006.01) |
| *D06F 58/24* | (2006.01) |

(52) U.S. Cl.

CPC ..... *F28D 1/0461* (2013.01); *F28D 1/0477* (2013.01); *F28D 7/08* (2013.01); *F28D 7/085* (2013.01); *F28D 9/0062* (2013.01); *F28D 9/0068* (2013.01); *F28F 1/32* (2013.01); *F28F 3/086* (2013.01); *F28F 9/001* (2013.01); *F28F 9/0265* (2013.01); *F28F 9/0275* (2013.01); *F28F 17/005* (2013.01); *D06F 58/24* (2013.01); *F28D 2021/0038* (2013.01); *Y10T 137/6579* (2015.04)

(56) References Cited

U.S. PATENT DOCUMENTS

| | | | | |
|---|---|---|---|---|
| 4,154,003 | A | 5/1979 | Muller | |
| 4,326,344 | A | 4/1982 | Smith | |
| 4,447,965 | A | 5/1984 | Bray | |
| 4,475,589 | A | 10/1984 | Mizuno et al. | |
| 4,609,039 | A | 9/1986 | Fushiki et al. | |
| 4,742,866 | A * | 5/1988 | Yamanaka | F16N 39/02 165/167 |
| 5,228,211 | A | 7/1993 | Stubbing | |
| 5,478,544 | A | 12/1995 | Schutte et al. | |
| 5,611,209 | A | 3/1997 | Ogasawara et al. | |
| 5,636,449 | A | 6/1997 | Gaddis et al. | |
| 6,112,426 | A | 9/2000 | Buttazzi | |
| 6,161,306 | A | 12/2000 | Clodic | |
| 6,427,454 | B1 | 8/2002 | West | |
| 6,478,855 | B1 | 11/2002 | Okano | |
| 6,585,871 | B1 | 7/2003 | Anzaki et al. | |
| 6,829,900 | B2 | 12/2004 | Urch | |
| 6,895,774 | B1 | 5/2005 | Ares et al. | |
| 6,904,703 | B2 | 6/2005 | Naganawa et al. | |
| 6,944,969 | B2 | 9/2005 | Clodic et al. | |
| 6,945,065 | B2 | 9/2005 | Lee et al. | |
| 6,973,795 | B1 | 12/2005 | Moffitt | |
| 7,007,495 | B2 | 3/2006 | Lee et al. | |
| 7,096,684 | B2 | 8/2006 | Yabu et al. | |
| 7,121,102 | B2 | 10/2006 | Fijas et al. | |
| 7,150,160 | B2 | 12/2006 | Herbert | |
| 7,191,604 | B1 | 3/2007 | Wiggs | |
| 7,201,013 | B2 | 4/2007 | Yabu | |
| 7,281,389 | B1 | 10/2007 | O'Brien et al. | |
| 7,337,615 | B2 | 3/2008 | Reidy | |
| 7,448,224 | B2 | 11/2008 | Wu et al. | |
| 7,469,486 | B2 | 12/2008 | Tamura et al. | |
| 7,526,879 | B2 | 5/2009 | Bae et al. | |
| 7,540,166 | B2 | 6/2009 | O'Brien et al. | |
| 7,581,408 | B2 | 9/2009 | Stark | |
| 8,015,832 | B2 | 9/2011 | Setoguchi et al. | |
| 8,240,064 | B2 | 8/2012 | Steffens | |
| 8,316,660 | B2 | 11/2012 | Demonte et al. | |
| 8,353,115 | B2 | 1/2013 | Steffens | |
| 8,438,751 | B2 | 5/2013 | Stolze | |
| 8,572,862 | B2 | 11/2013 | Tegrotenhuis | |
| 8,650,770 | B1 | 2/2014 | Levy | |
| 8,769,971 | B2 | 7/2014 | Kozubal et al. | |
| 9,689,626 | B2 | 6/2017 | Van Heeswijk et al. | |
| 2002/0116935 | A1 | 8/2002 | Forkosh et al. | |
| 2003/0075222 | A1 | 4/2003 | Smith, IV et al. | |
| 2004/0107723 | A1 | 6/2004 | Lee et al. | |
| 2004/0250557 | A1 | 12/2004 | Yabu et al. | |
| 2005/0081576 | A1 | 4/2005 | Park et al. | |
| 2006/0168842 | A1 | 8/2006 | Sprague | |
| 2007/0079619 | A1 | 4/2007 | Hamada et al. | |
| 2007/0266726 | A1 | 11/2007 | Tada et al. | |
| 2008/0006039 | A1 | 1/2008 | Kim et al. | |
| 2008/0083230 | A1 | 4/2008 | Giallombardo | |
| 2008/0189973 | A1 | 8/2008 | Dittmer et al. | |
| 2008/0223050 | A1 | 9/2008 | Bruders et al. | |
| 2008/0235977 | A1 | 10/2008 | Kuwabara | |
| 2009/0205354 | A1 | 8/2009 | Brown | |
| 2009/0314480 | A1 | 12/2009 | Grinbergs et al. | |
| 2010/0132930 | A1 | 6/2010 | Izenson et al. | |
| 2010/0181055 | A1 | 7/2010 | Yamada | |
| 2010/0212334 | A1 | 8/2010 | Demonte et al. | |
| 2010/0212335 | A1 | 8/2010 | Lukitobudi | |
| 2010/0257878 | A1 | 10/2010 | Arbel et al. | |
| 2010/0275621 | A1 | 11/2010 | Oliveira, Jr. | |
| 2010/0294458 | A1 | 11/2010 | Murayama et al. | |
| 2012/0030959 | A1 | 2/2012 | Yang | |
| 2012/0107663 | A1 | 5/2012 | Burgers et al. | |
| 2012/0233876 | A1 | 9/2012 | Weldon et al. | |
| 2013/0047662 | A1 | 2/2013 | Black et al. | |
| 2014/0082960 | A1 | 3/2014 | Bison et al. | |
| 2014/0261764 | A1 | 9/2014 | Kohavi et al. | |

FOREIGN PATENT DOCUMENTS

| | | |
|---|---|---|
| DE | 3446468 | 7/1986 |
| DE | 199 13 938 | 9/2000 |
| DE | 202 02 782 | 4/2002 |
| DE | 10 2007 016077 | 10/2008 |
| DE | 10 2008 004459 | 7/2009 |
| DE | 10 2008 043176 | 4/2010 |
| EP | 0 467 188 | 1/1992 |
| EP | 0861403 | 9/1996 |
| EP | 1 443 281 | 8/2004 |
| EP | 2 267 207 | 12/2010 |
| EP | 2511636 | 10/2012 |
| EP | 2576888 | 3/2014 |
| EP | 2576889 | 4/2014 |
| FR | 2515805 | 5/1983 |
| GB | 570 541 | 7/1945 |
| GB | 938088 | 3/1961 |
| GB | 2 375 812 | 11/2002 |
| JP | S56132471 | 10/1981 |
| JP | S58117941 | 7/1983 |
| JP | 2001263729 | 9/2001 |
| WO | WO 2000/026595 | 5/2000 |
| WO | WO 2010/118965 | 10/2010 |
| WO | WO 2013/000955 | 1/2013 |
| WO | WO 2014/141059 | 9/2014 |
| WO | WO 2015/136393 | 9/2015 |

* cited by examiner

⊗ Flow inward (702)
⊙ Flow outward (700)

PLANAR ELEMENT FOR FORMING HEAT EXCHANGER

CROSS REFERENCE TO RELATED APPLICATIONS

This application is a Continuation of U.S. patent application Ser. No. 15/960,550, filed on Apr. 24, 2018, which is a Continuation of U.S. patent application Ser. No. 14/859,910, filed on Sep. 21, 2015, which is a Continuation of U.S. patent application Ser. No. 13/834,857, filed on Mar. 15, 2013, each of which is incorporated herein by reference in its entirety.

FIELD OF THE INVENTION

The present invention relates to dehumidification generally.

BACKGROUND OF THE INVENTION

Various types of dehumidifiers are known in the art.

SUMMARY OF THE INVENTION

The present invention seeks to provide improved heat exchanger planar elements.

There is thus provided in accordance with a preferred embodiment of the present invention planar element adapted to form, when stacked with a plurality of other such elements, a heat exchanger, the planar element comprising an inlet region, a first zone adapted to direct flow from the inlet region towards a second zone, a second zone comprising at least one cutout in the plane of the planar element, adapted to accommodate a cooling core, a third zone, adapted to direct flow from the second zone towards an outlet region and an outlet region. Preferably the perimeter of the planar element comprises side edges.

According to embodiments of the present invention the planar element may comprise a first blockage protrusion disposed along a first group of said side edges, the first group comprising at least a side edge adjacent to said outlet region, the first blockage protrusion is adapted to block flow from said inlet region directly to said outlet region and a second blockage protrusion disposed along a second group of said side edges, the second group comprising at least a side edge adjacent to said inlet region, the second blockage protrusion is adapted to block flow from said outlet region directly to said inlet region.

According to further embodiments the planar element comprise at least one first guiding protrusion adapted to guide the airflow within said first region from the inlet region. The planar element may further comprise at least one second guiding protrusion adapted to guide the airflow within said third region toward the outlet region.

According to yet further embodiments the planer element may comprise at least one third protrusion is disposed in said first region and adapted to keep a defined gap between said planar element and a second planar element disposed adjacent to the planar element, in the inlet region.

According to further embodiments the planar element may further comprise at least one fourth protrusion is disposed in said third region and adapted to keep a defined gap between said planar element and a second planar element disposed adjacent to said planar element, in the outlet region and at least one fifth protrusion disposed around said cutout adapted to keep a defined gap between said planar element and a second planar element disposed adjacent to the planar element, in the cutout region.

According to further embodiments the planar element may further comprise at least a first set of relatively parallel protrusions adapted to guide the airflow within said first region and at least a second set of relatively parallel protrusions adapted to guide the airflow within said third region.

BRIEF DESCRIPTION OF THE DRAWINGS

The present invention will be understood and appreciated more fully from the drawings in which:

FIG. 14A is a planar view and FIGS. 14B, 14C and 14D are sectional views taken along respective section lines B-B, C-C and D-D in FIG. 14A.

DETAILED DESCRIPTION OF THE INVENTION

Figures 1A, 1B:
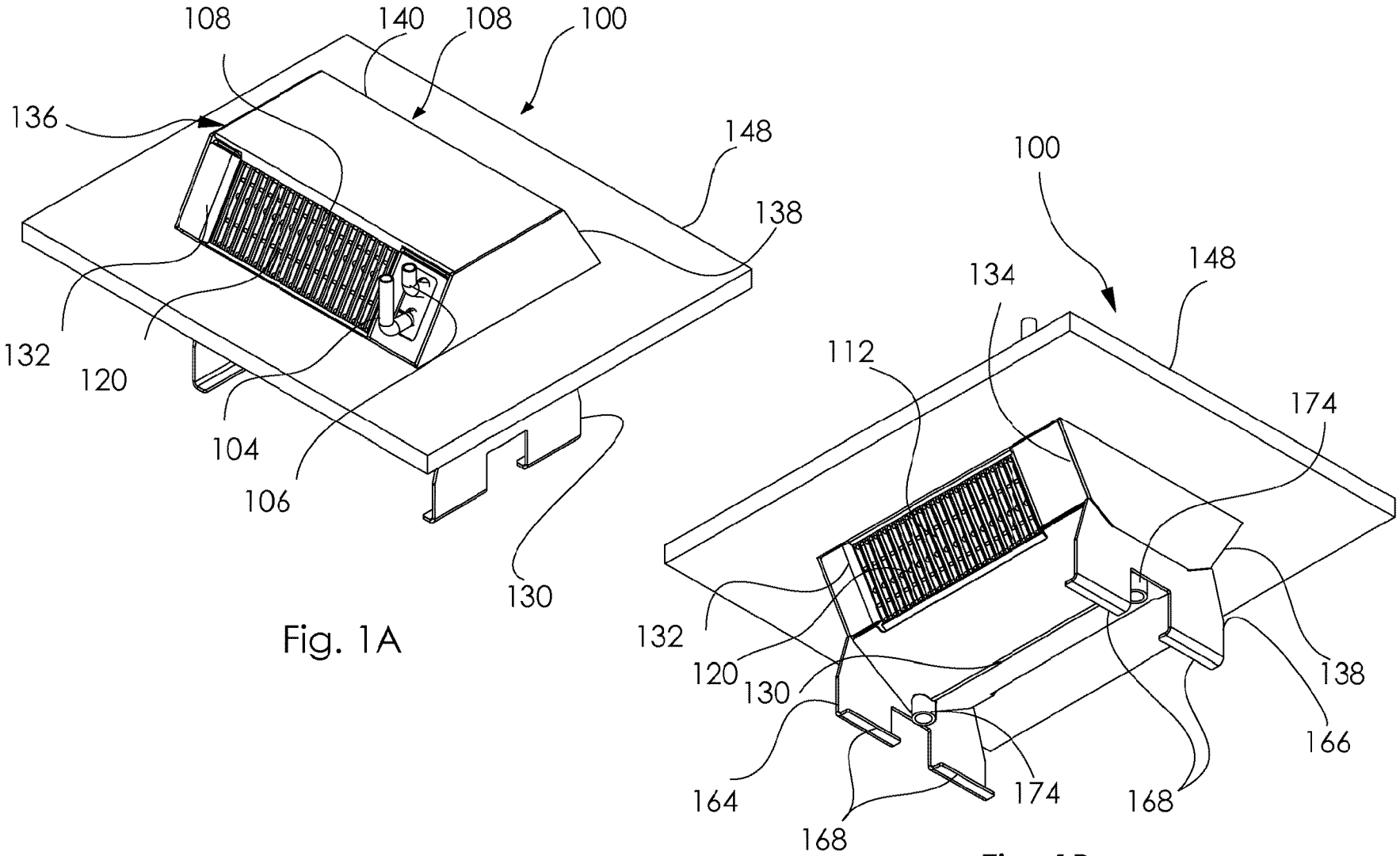
FIGS. 1A and 1B are simplified top view and bottom view pictorial illustrations of a dehumidification apparatus constructed and operative in accordance with a preferred embodiment of the present invention.

The present invention describes apparatus which produces dehumidification and can be embodied in a number of alternative operational contexts, such as part of a dehumidification apparatus, an air conditioner or a water generation system providing water for drinking or any other use. The apparatus described hereinabove normally requires an air flow of humid air thereto and a concomitant air pressure gradient thereacross. It also requires provision of a coolant fluid, which may be any suitable gas or liquid.

Reference is now made to FIGS. 1A-3B, which are simplified pictorial illustrations of a dehumidification apparatus 100 constructed and operative in accordance with a preferred embodiment of the present invention. As seen in FIGS. 1A-3B, the dehumidification apparatus 100 includes a cooled core 102 coupled to an external cooling source (not shown) via a cooling fluid inlet pipe 104 and a cooling fluid outlet pipe 106. The cooling fluid may be any suitable coolant, such as ammonia or FREON®, which are supplied in a partially liquid phase and change to a gaseous phase in the core 102, or a chilled liquid, typically water or alcohol, which remains throughout in a liquid phase.

At least first and second relatively humid air inlet pathways 108 lead to the cooled core 102 and at least first and second relatively dry air outlet pathways 112 extend from the cooled core 102.

In accordance with a preferred embodiment of the present invention, there is provided a core-surrounding air flow pre-cooling and post heating assembly (CSAFPCPHA) 120 wherein the at least first and second relatively dry air outlet pathways 112 are in heat exchange propinquity with respective ones of the at least first and second relatively humid air inlet pathways 108, whereby relatively humid air in the first and second relatively humid air inlet pathways is precooled upstream of the cooled core 102 and relatively dry air in the first and second relatively dry air outlet pathways is heated downstream of the cooled core 102.

It is a particular feature of an embodiment of the present invention that the cooled core 102 is formed of core elements, such as core plates 122, along which an air flow passes, and the at least first and second relatively humid air inlet pathways and the at least first and second relatively dry air outlet pathways are formed of pathway elements, such as embossed generally planar elements 124 and 126, along which an air flow passes, the core elements having a relatively high thermal conductivity in a direction along which the air flow passes and the pathway elements having a relatively low thermal conductivity in a direction along which the air flow passes. It is appreciated that core plates 122 are aligned with and sealed with respect to corresponding planar elements 124 and 126.

Figure 1C:
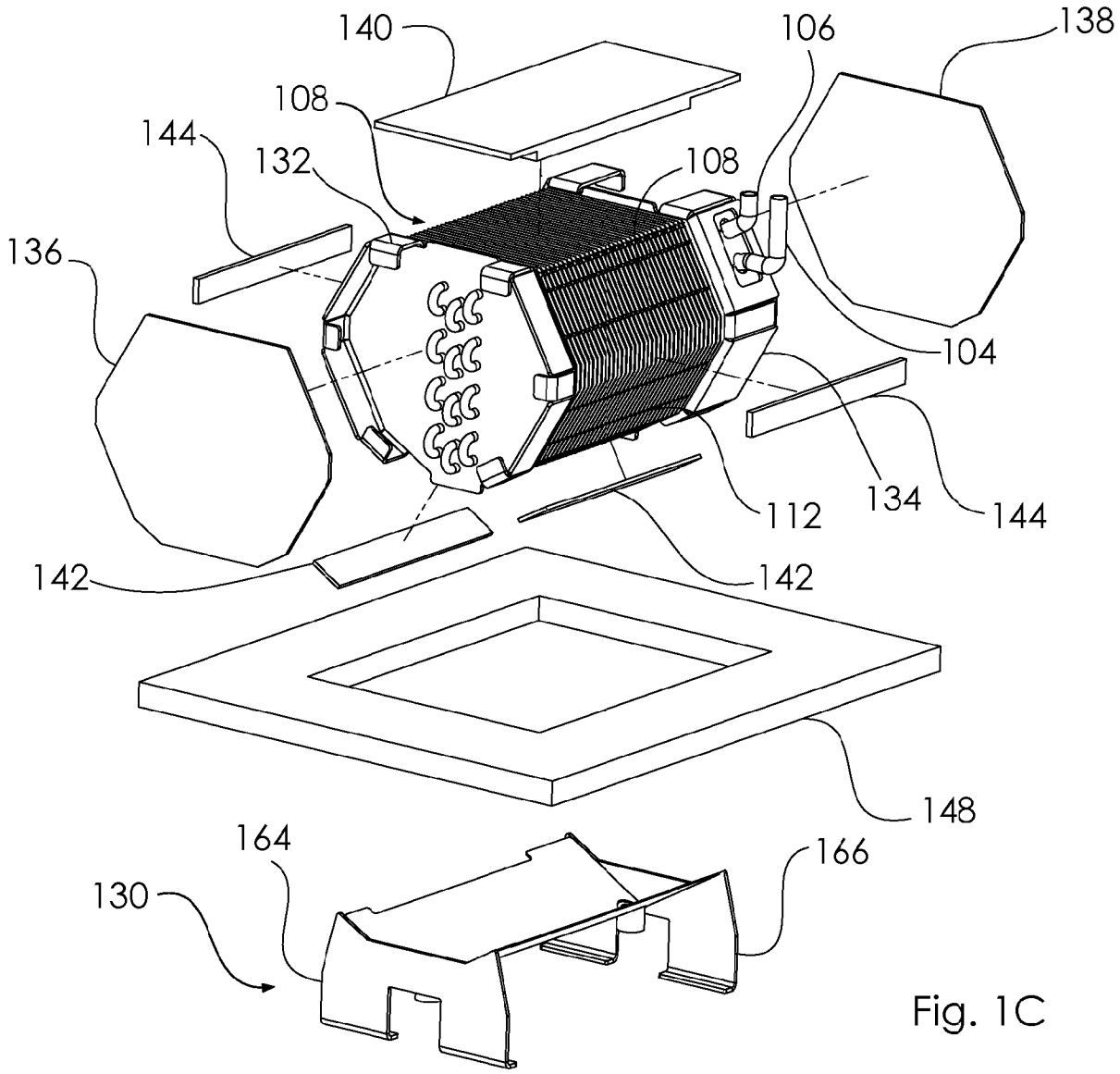
FIG. 1C is a simplified exploded view illustration of the dehumidification apparatus of FIGS. 1A & 1B.

As seen particularly in FIGS. 1A-1C, the dehumidification apparatus 100 also preferably includes a base subassembly 130, which provides a sump for drainage of condensate, end plate subassemblies 132 and 134, end cover plates 136 and 138, a top air flow sealing plate 140 which preferably restricts inlet air flow to be along the passageways 108, a pair of bottom air flow sealing plates 142 which preferably restrict outlet air flow to be along the passageways 112 and a pair of side air flow sealing plates 144, which separate between respective pairs of inlet and outlet air flow passageways 108 and 112. A circumferential plate 148, shown here symbolically, separates between an ambient relatively humid air environment which is maintained at a relatively high pressure and a relatively dry air environment, which is maintained at a relatively low pressure.

Figures 2A, 2B:
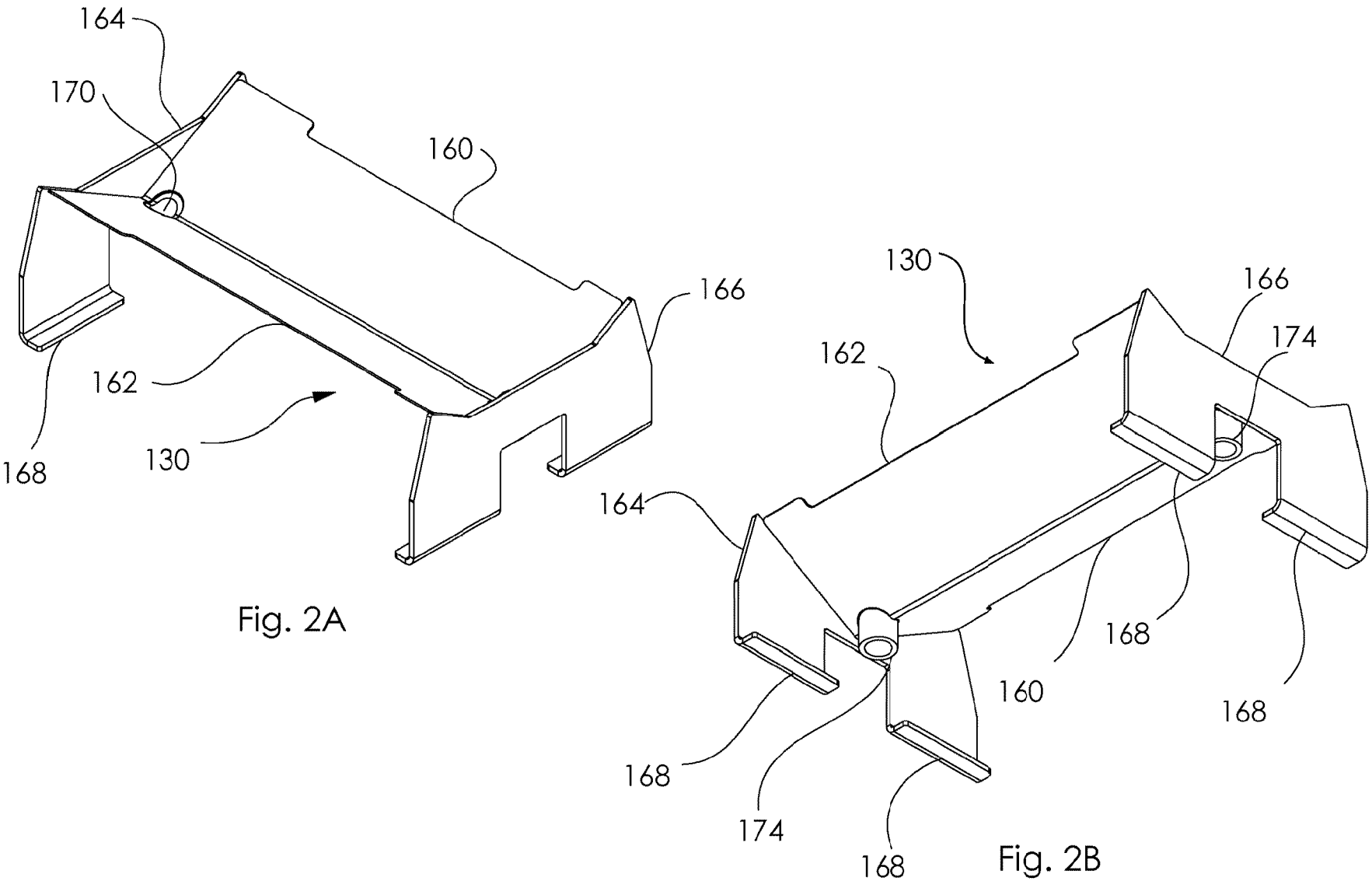
FIGS. 2A and 2B are simplified top view and bottom view illustrations of a base element, forming an optional part of the dehumidification apparatus of FIGS. 1A-1C.

Turning now specifically to FIGS. 2A & 2B, which are simplified illustrations of a base subassembly forming an optional part of the dehumidification apparatus of FIGS. 1A & 1B, it is seen that the base subassembly is typically welded of sheet metal and includes a pair of mutually inclined plates 160 and 162 which are joined by a pair of end portions 164 and 166 which define legs 168. A pair of sump apertures 170 are preferably formed at opposite ends of the junction of plates 160 and 162 and are preferably fitted with respective sump pipes 174.

Figure 3A:
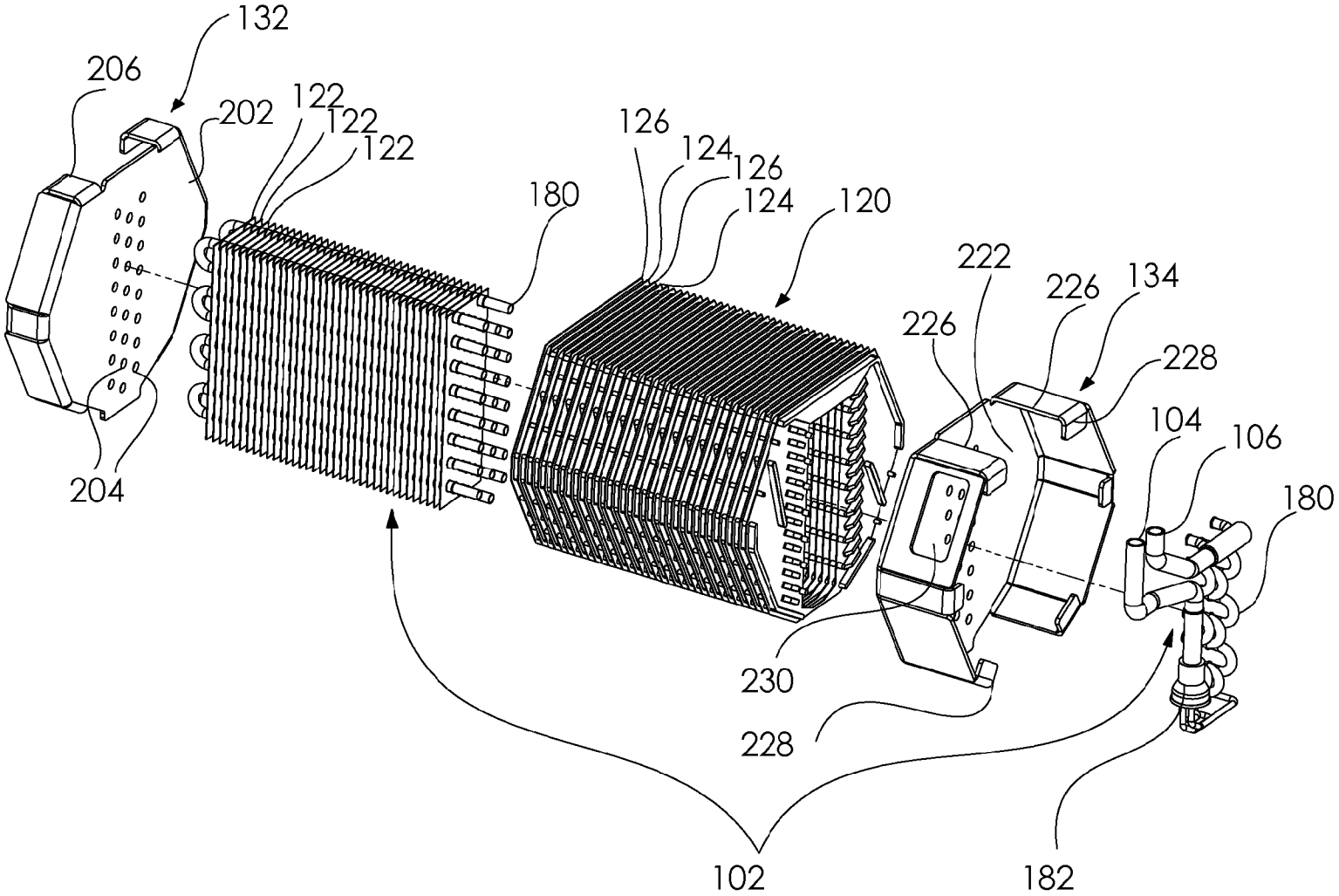
FIGS. 3A and 3B are exploded view illustrations of a heat exchange assembly including a cooling core and a core-surrounding air flow pre-cooling and post heating assembly (CSAFPCPHA) constructed and operative in accordance with first and second preferred embodiments of the invention and forming part of the dehumidification apparatus of FIGS. 1A-1C.
Figure 6A:
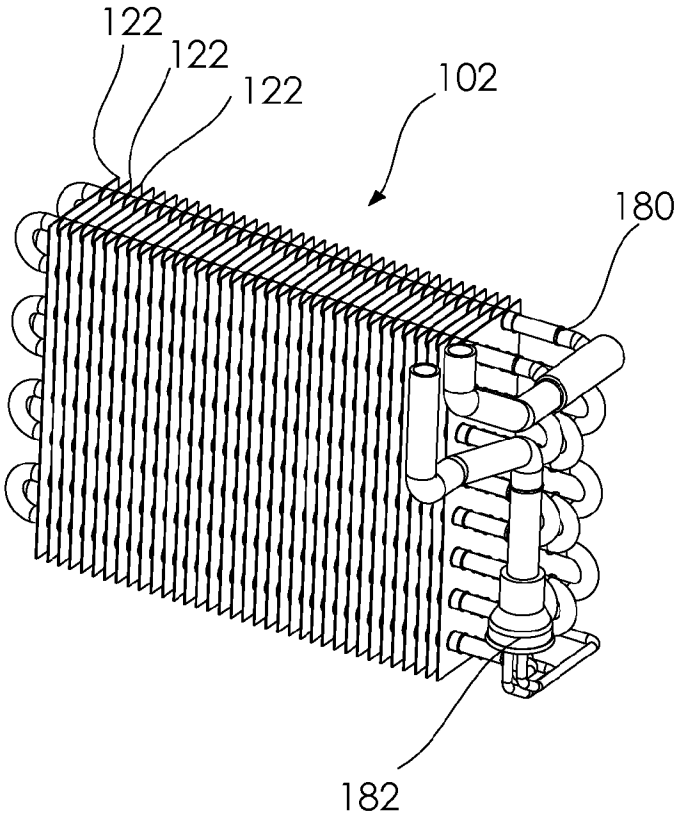
FIGS. 6A and 6B are respective simplified assembled view and exploded view illustrations of a cooling core assembly forming part of the heat exchange assembly of FIG. 3A.
Figure 6B:
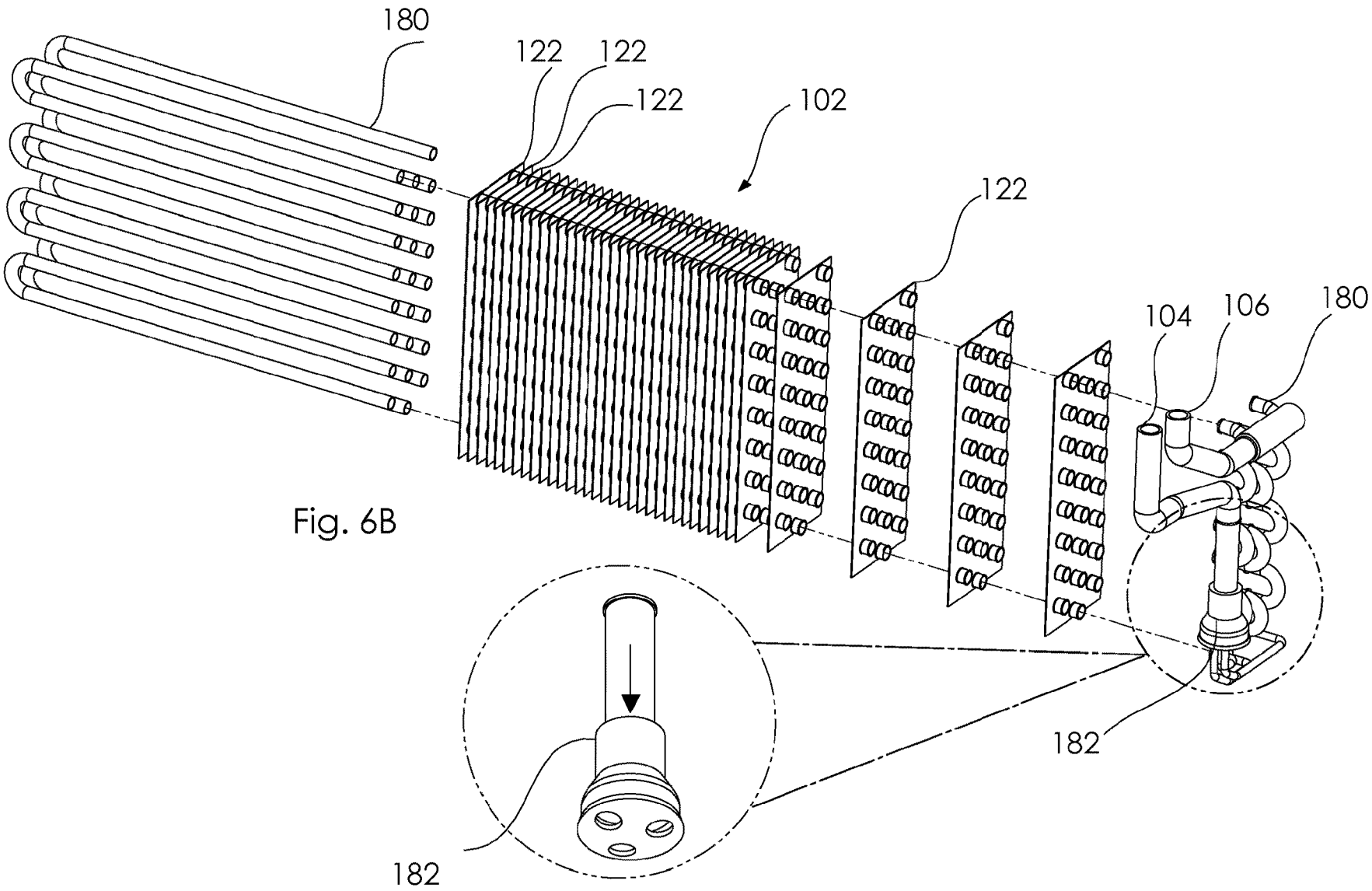

Turning now to FIGS. 3A and 6A & 6B, it is noted that these drawings illustrate a heat exchange assembly including a cooling core 102 and a core-surrounding air flow pre-cooling and post heating assembly (CSAFPCPHA) 120 particularly suited for use with a gaseous coolant, such as FREON®, and accordingly coolant piping 180 is preferably provided with a distributor 182, which divides a flow of gas into multiple separate flows, each of which passes through a separate gas circulation pathway.

Figure 3B:
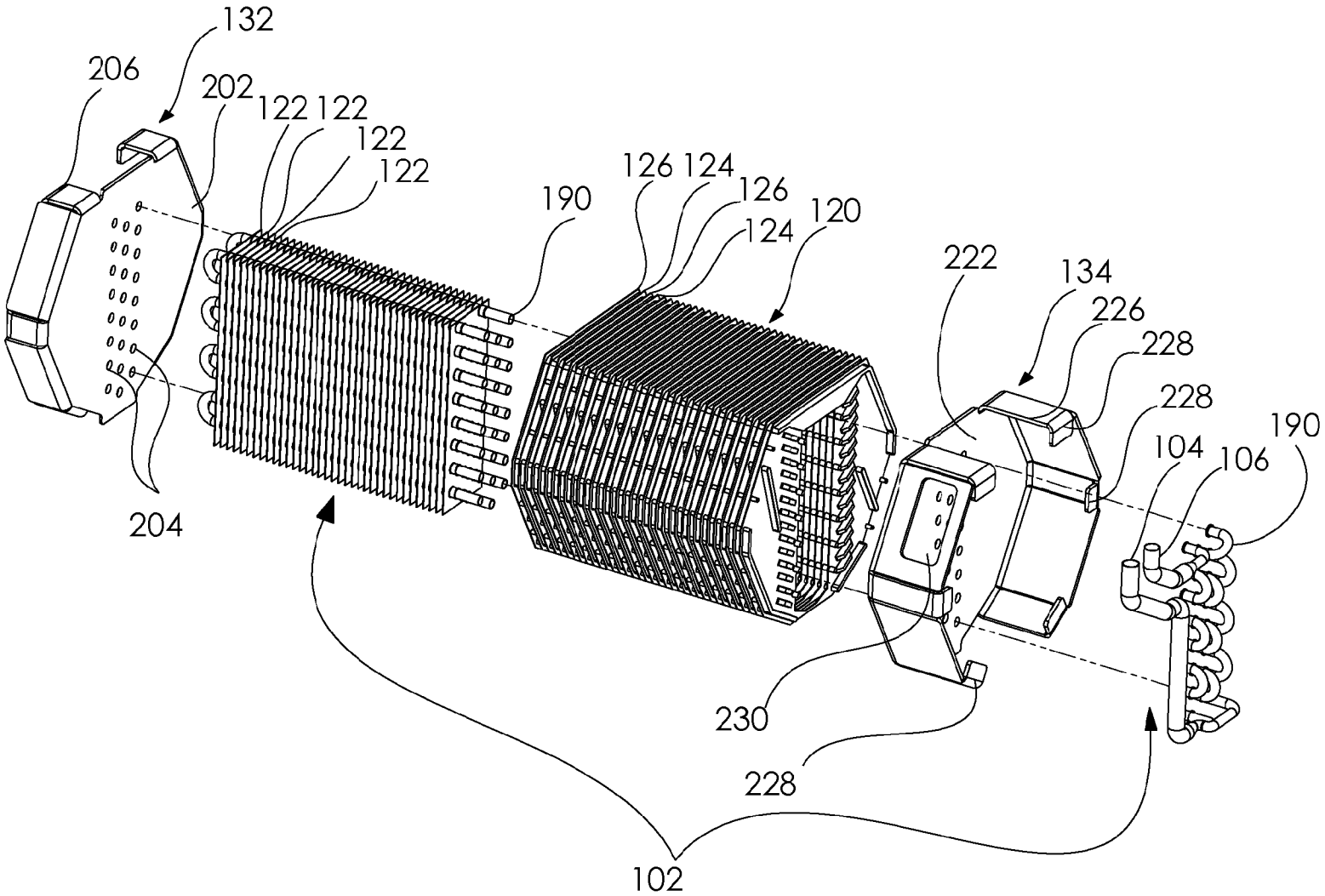
Figure 7A:
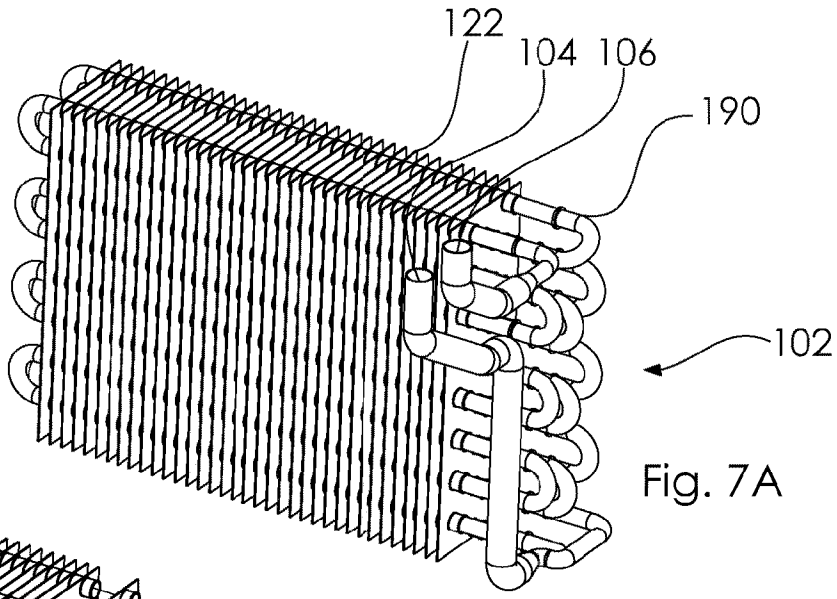
FIGS. 7A and 7B are respective simplified assembled view and exploded view illustrations of a cooling core assembly forming part of the heat exchange assembly of FIG. 3B.
Figure 7B:
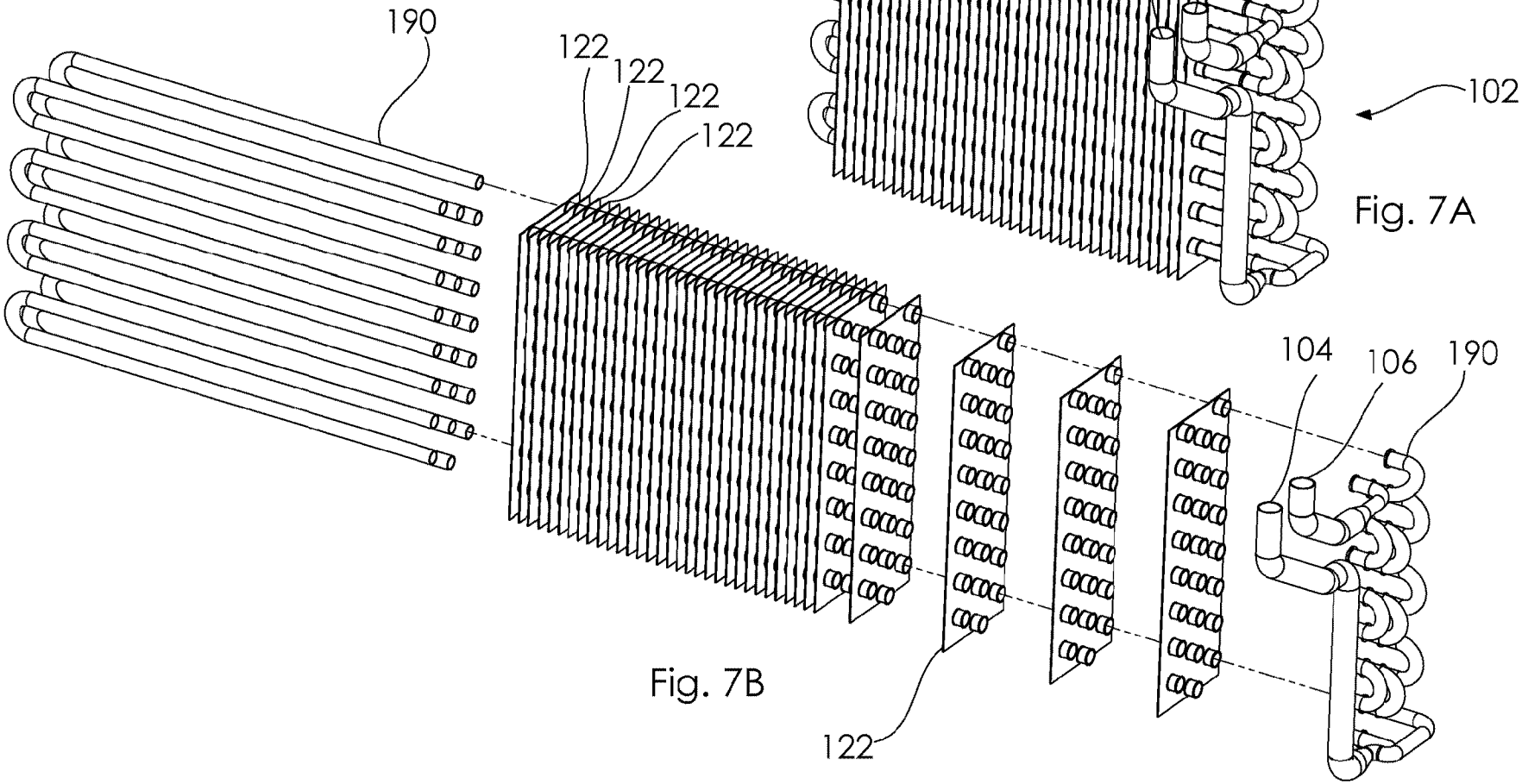

Turning now to FIGS. 3B and 7A & 7B, it is noted that these drawings illustrate a heat exchange assembly including a cooling core 102 and a core-surrounding air flow pre-cooling and post heating assembly (CSAFPCPHA) 120 particularly suited for use with a liquid coolant, such as chilled water or alcohol, and accordingly coolant piping 190 is preferably provided without a distributor 182.

Figure 4B:
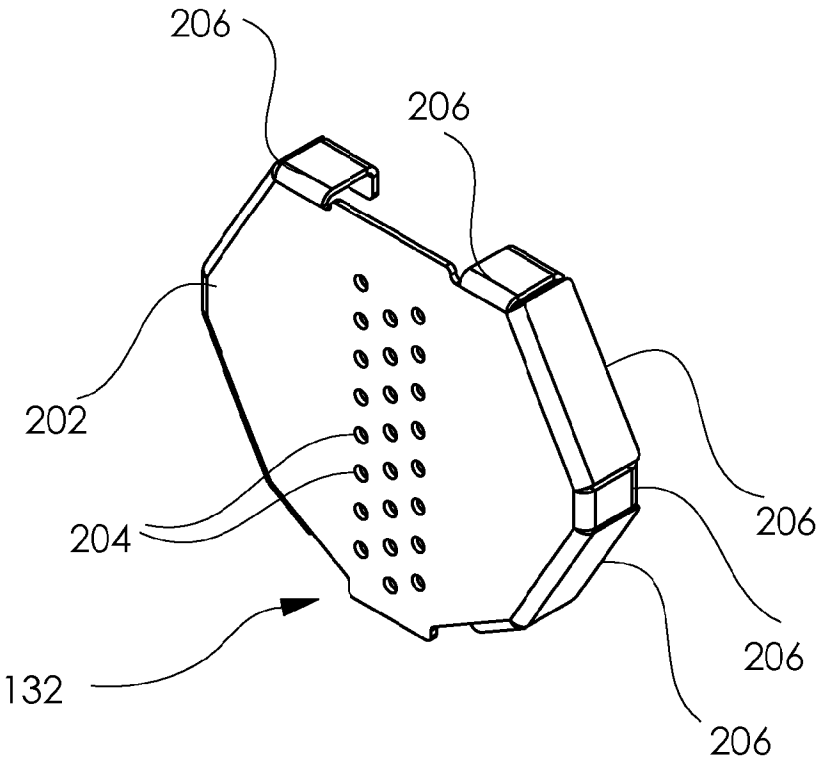
FIGS. 4A and 4B are simplified illustrations of a first end plate element, forming part of the dehumidification apparatus of FIGS. 1A-1C.
Figure 4A:
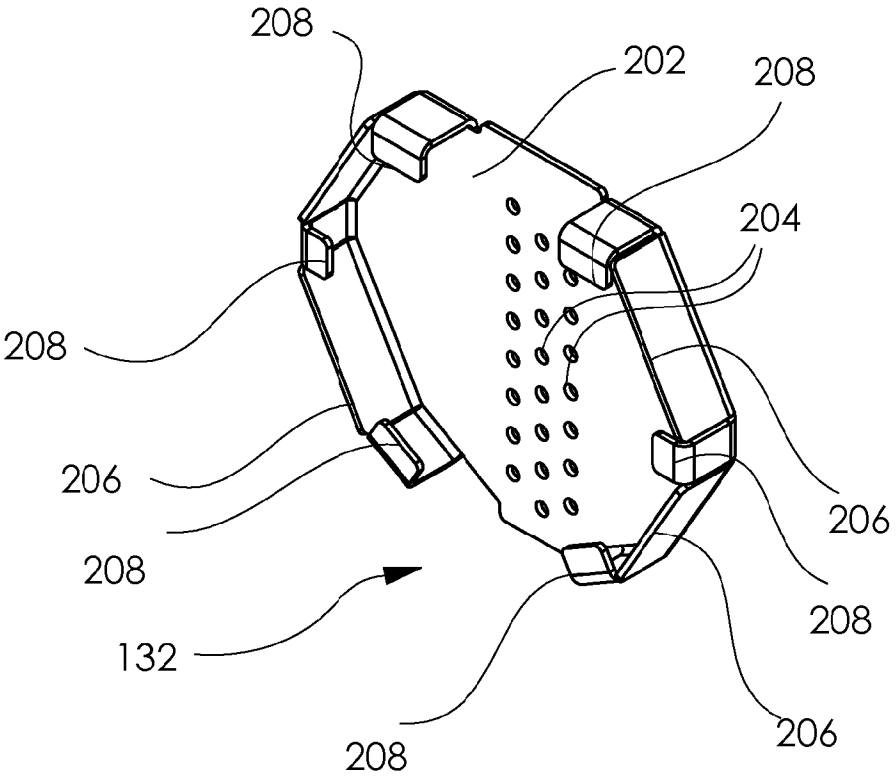

Reference is now made to FIGS. 4A & 4B, which illustrate end plate 132. It is seen that end plate 132 comprises a generally planar portion 202 having an array of apertures 204 arranged to accommodate coolant piping, such as piping 180 or 190, and preferably includes a plurality of bent over edges 206 and a plurality of double bent over edges 208 onto which end cover plate 136 may be sealingly attached.

Figure 5B:
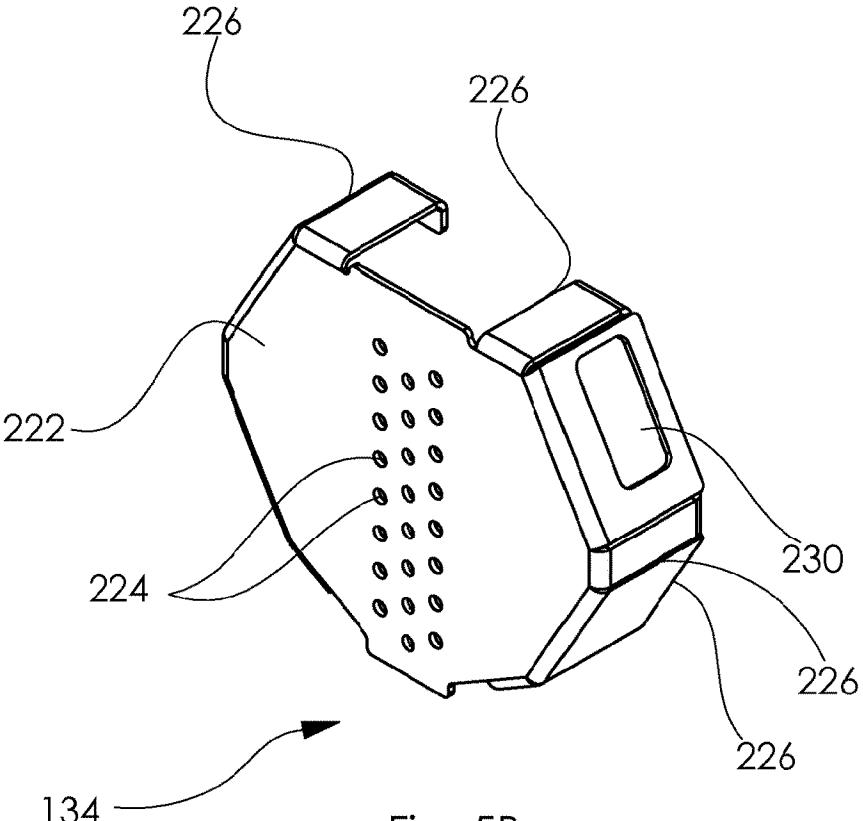
FIGS. 5A and 5B are simplified illustrations of a second end plate element, forming part of the dehumidification apparatus of FIGS. 1A-1C.
Figure 5A:
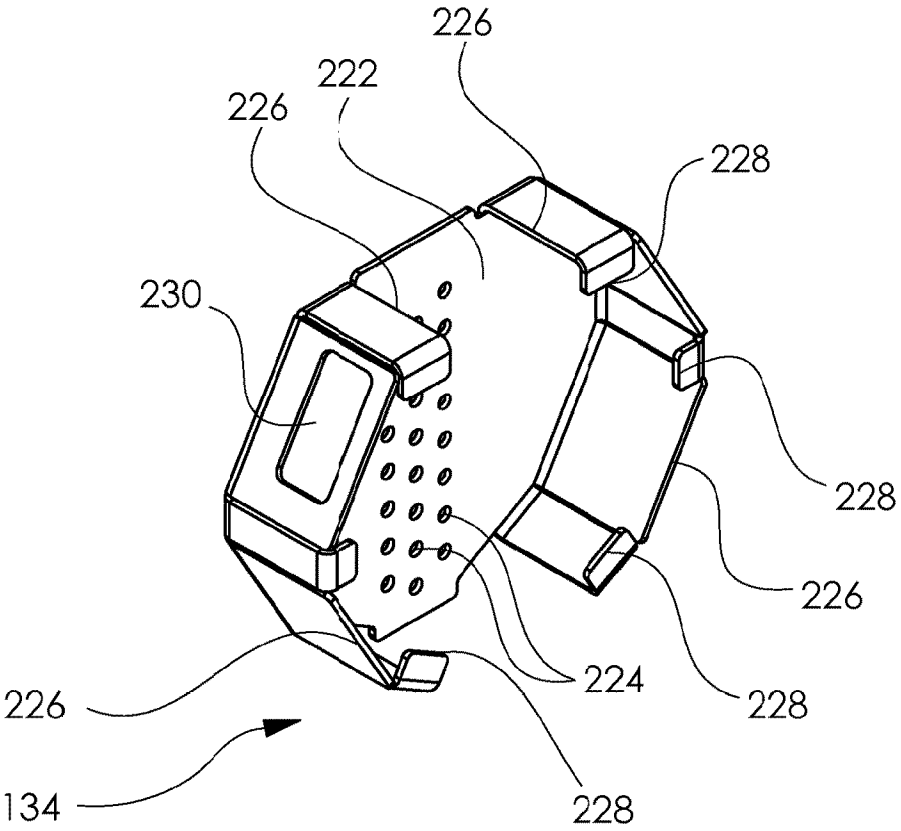

Reference is now made to FIGS. 5A & 5B, which illustrate end plate 134. It is seen that end plate 134 comprises a generally planar portion 222 having an array of apertures 224 arranged to accommodate coolant piping, such as piping 180 or 190, and preferably includes a plurality of bent over edges 226 and a plurality of double bent over edges 228 onto which end cover plate 138 may be attached. It is noted that one of bent over edges 226 is preferably formed with an aperture 230 which accommodates cooling fluid inlet pipe 104 and cooling fluid outlet pipe 106.

Figure 8A:
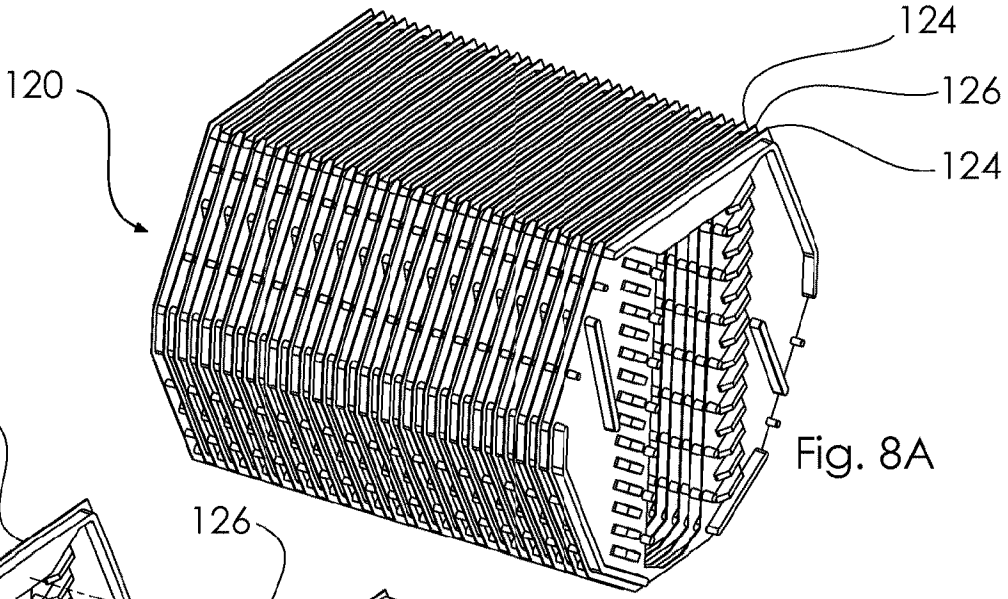
FIGS. 8A and 8B are respective simplified assembled view and exploded view illustrations of a core-surrounding air flow pre-cooling and post heating assembly (CSAFPCPHA) forming part of the heat exchange assembly of FIGS. 3A & 3B.
Figure 8B:
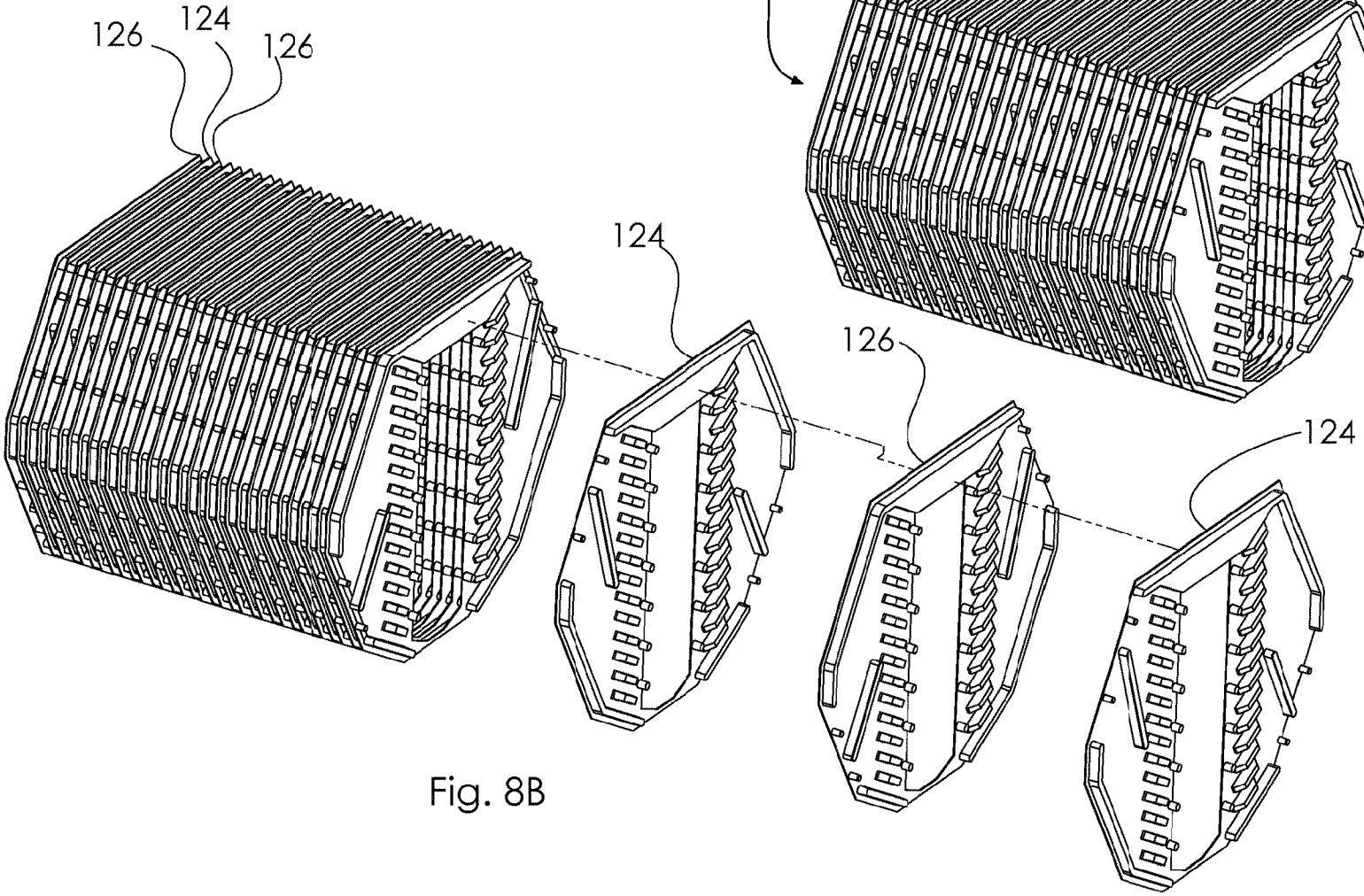

Reference is now made to FIGS. 8A-12B, which illustrate the structure of the core-surrounding air flow pre-cooling and post heating assembly (CSAFPCPHA). As seen in FIGS. 8A & 8B, the CSAFPCPHA is made up of a stack of two different embossed generally planar elements 124 and 126 which are preferably arranged in mutually interdigitated touching relationship with each other about the core 102.

The structure and operation of embossed generally planar elements 124 and 126 will now be described with specific reference to FIGS. 9A-12B. It is noted that planar elements 124 and 126 are preferably formed by conventional vacuum forming techniques from relatively non-conductive flexible material, typically plastic, such as PVC and PET, typically of thickness 0.3 mm.

Figure 9B:
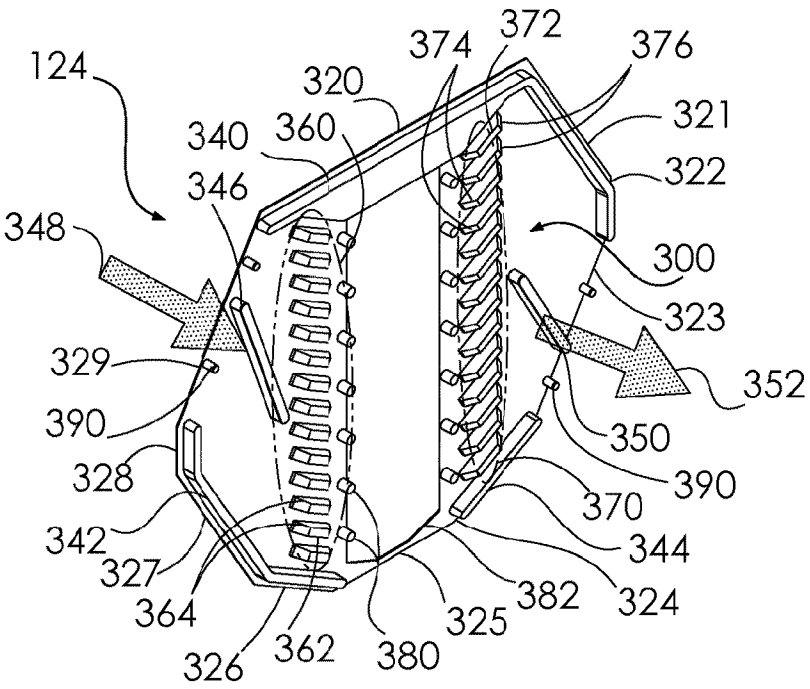
FIGS. 9A and 9B are respective simplified plan view and pictorial view illustrations of a first side of a first plate of the core-surrounding air flow pre-cooling and post heating assembly (CSAFPCPHA)
Figure 9A:
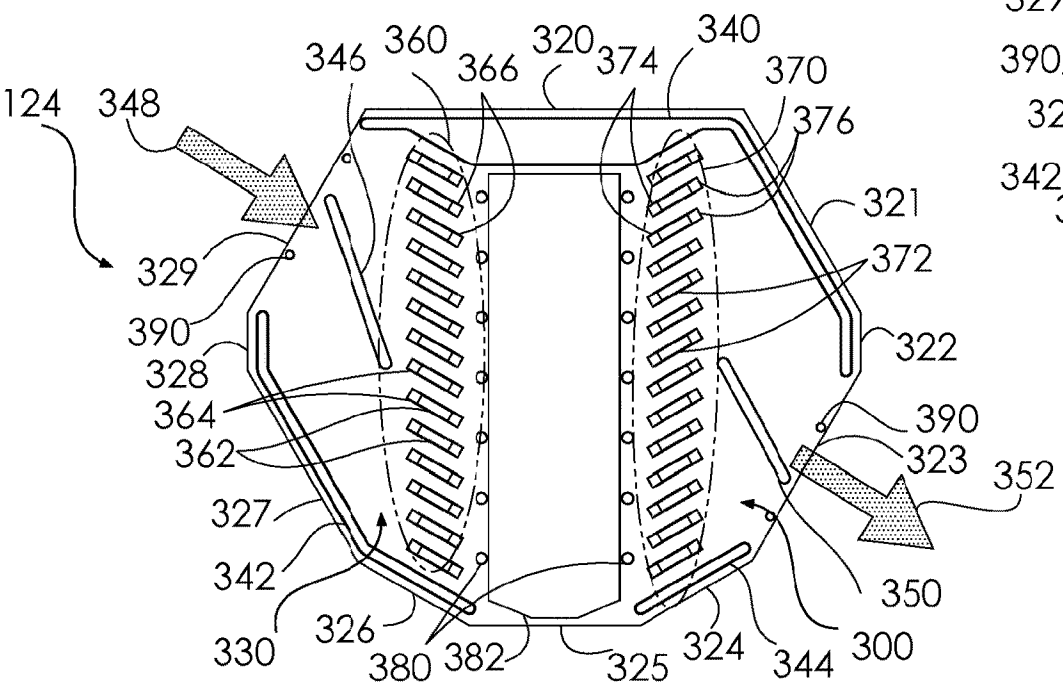
Figure 10B:
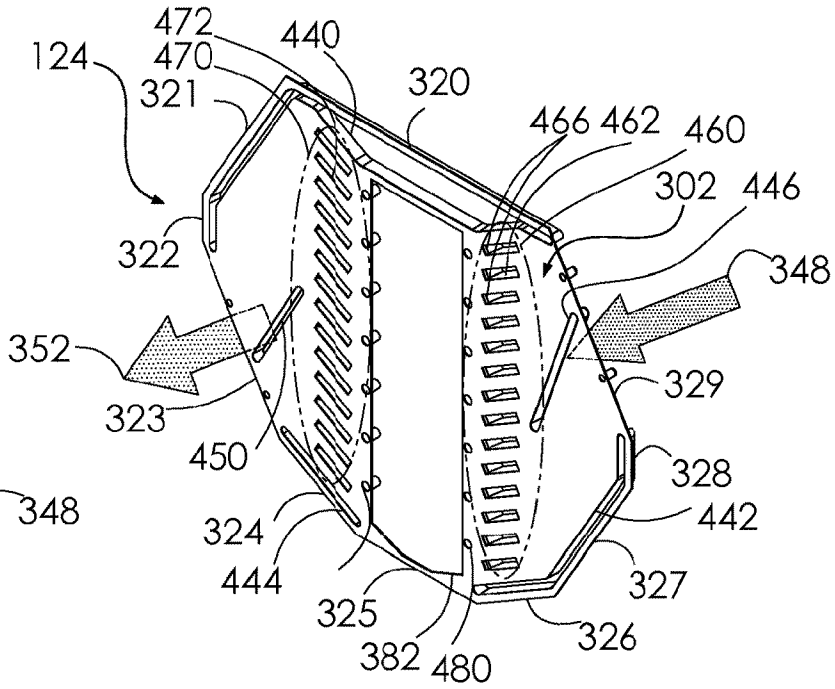
FIGS. 10A and 10B are respective simplified plan view and pictorial view illustrations of a second side of a first plate of the core-surrounding air flow pre-cooling and post heating assembly (CSAFPCPHA)
Figure 10A:
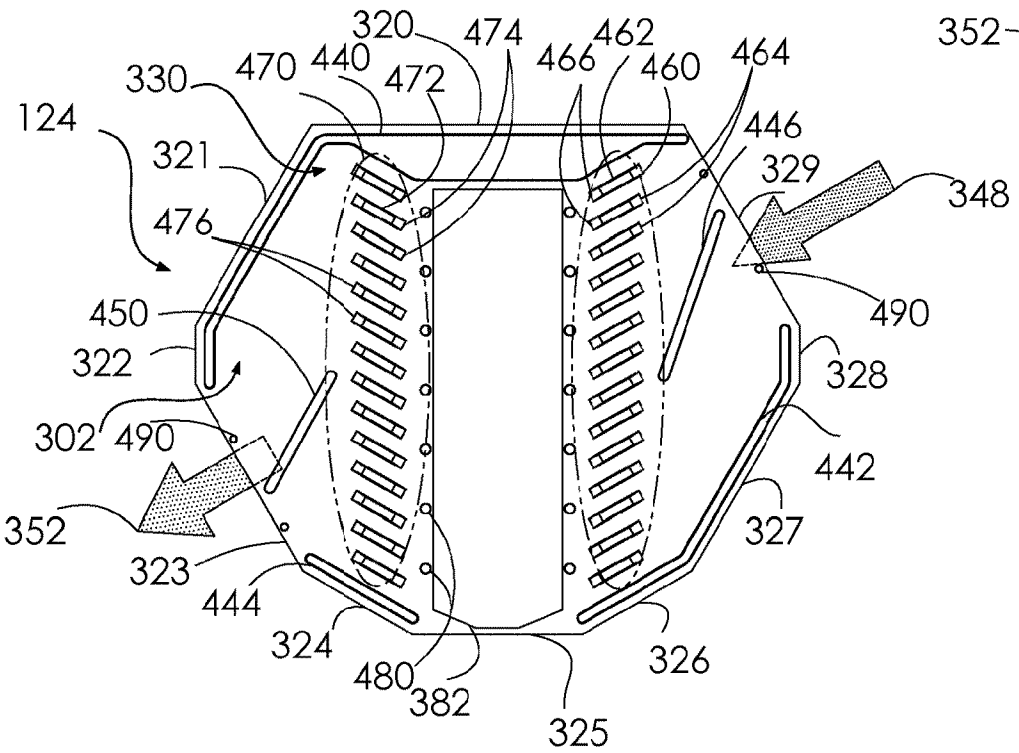

Turning first to generally planar element 124, a first side thereof, designated by reference numeral 300, is shown in FIGS. 9A and 9B and a second side thereof, designated by reference numeral 302, is shown in FIGS. 10A and 10B. Planar element 124 preferably has ten side edges, which are designated, clockwise with reference to FIG. 9A, by reference numerals 320, 321, 322, 323, 324, 325, 326, 327, 328 and 329. Planar element 124 is formed with a number of protrusions, which extend above the plane, designated by reference numeral 330, of planar element 124, in the sense of FIG. 9A, to a height of approximately 3 mm and which will now be described in detail. Due to manufacture of planar elements 124 and 126 by vacuum forming, there are recesses which correspond with each of the protrusions.

As seen in FIGS. 9A & 9B, a first side 300 of planar element 124 includes an air flow blockage protrusion 340, which extends clockwise in the sense of FIG. 9A, at first narrowly, from a location near the junction of edges 320 and 329, along and slightly spaced from edge 320 where it becomes wider and then narrows, and narrowly along and spaced from edges 321 and 322. Protrusion 340 serves to prevent air flow above plane 330 via edges 320, 321 and 322. Planar element 124 also includes an air flow blockage protrusion 342, which extends clockwise in the sense of FIG. 9A, narrowly, from a location near the junction of edges 325 and 326 and along and slightly spaced from edges 326, 327 and 328. Protrusion 342 serves to prevent air flow above plane 330 via edges 326, 327 and 328. Planar element 124 also includes an air flow blockage protrusion 344, which extends along and slightly spaced from edge 324. Protrusion 344 serves to prevent air flow above plane 330 via edge 324.

Planar element 124 also includes, at first side 300, an air flow guiding protrusion 346 at what is typically an inlet region 348 above plane 330 and an air flow guiding protrusion 350 at what is typically an outlet region 352 above plane 330.

Planar element 124 also includes, at first side 300, an array 360 of mutually spaced enhanced counter flow heat exchange (ECFHE) protrusions 362 downstream of inlet region 348. Each of mutually spaced protrusions 362 preferably has a tapered inlet end 364 and a tapered outlet end 366.

Planar element 124 also includes, at first side 300, an array 370 of mutually spaced enhanced counter flow heat exchange (ECFHE) protrusions 372 upstream of outlet region 352. Each of mutually spaced protrusions 372 preferably has a tapered inlet end 374 and a tapered outlet end 376.

Planar element 124 also includes, at first side 300, a plurality of mutual inner edge spacing protrusions 380 preferably arranged at the sides of a generally rectangular cutout 382 which accommodates core 102.

Planar element 124 also includes, at first side 300, a plurality of mutual outer edge spacing protrusions 390 preferably arranged along edges 323 and 329.

As seen in FIGS. 10A & 10B, second side 302 of planar element 124 includes a recess 440, which extends counterclockwise in the sense of FIG. 10A, at first narrowly, from a location near the junction of edges 320 and 329, along and slightly spaced from edge 320, where it becomes wider and then narrows, and narrowly along and spaced from edges 321 and 322. Planar element 124 also includes a recess 442, which extends counterclockwise in the sense of FIG. 10A, narrowly, from a location near the junction of edges 325 and 326 and along and slightly spaced from edges 326, 327 and 328. Planar element 124 also includes a recess 444, which extends along and slightly spaced from edge 324. Recesses 440, 442 and 444 cooperate with corresponding protrusions on planar element 126 to provide enhanced registration of the stack of interdigitated planar elements 124 and 126.

Planar element 124 also typically includes, at second side 302, a recess 446 at inlet region 348 and a recess 450 at outlet region 352.

Planar element 124 also includes, at second side 302, an array 460 of mutually spaced enhanced counter flow heat exchange (ECFHE) recesses 462 downstream of inlet region 448. Each of mutually spaced recesses 462 preferably has a tapered inlet end 464 and a tapered outlet end 466.

Planar element 124 also includes, at second side 302, an array 470 of mutually spaced enhanced counter flow heat exchange (ECFHE) recesses 472 upstream of outlet region 352. Each of mutually spaced recesses 472 preferably has a tapered inlet end 474 and a tapered outlet end 476.

Planar element 124 also includes, at second side 302, a plurality of mutual inner edge spacing recesses 480 preferably arranged at the sides of generally rectangular cutout 382 which accommodates core 102.

Planar element 124 also includes, at second side 302, a plurality of outer edge recesses 490 preferably arranged along edges 323 and 329.

Figure 11B:
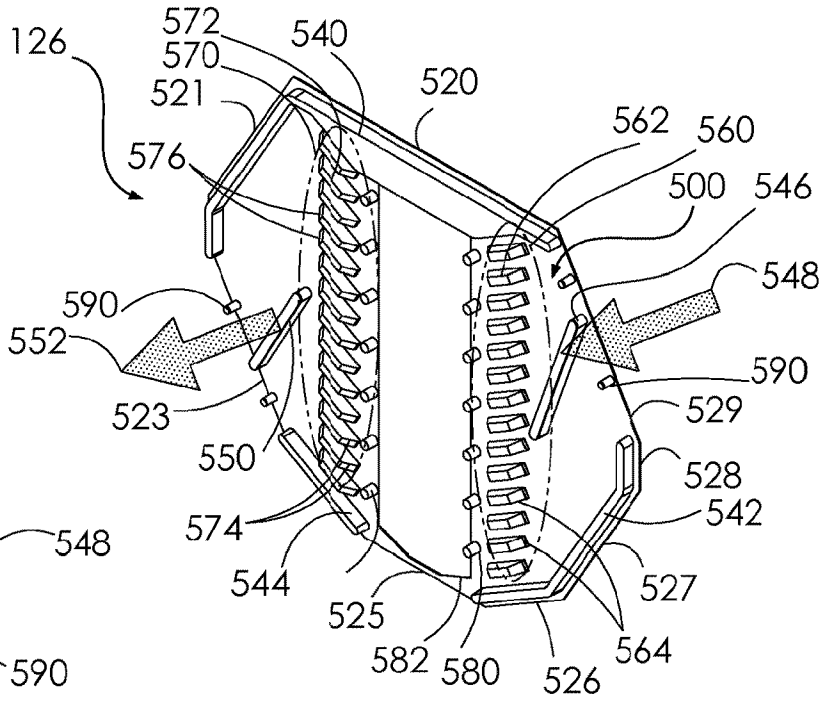
FIGS. 11A and 11B are respective simplified plan view and pictorial view illustrations of a first side of a second plate of the core-surrounding air flow pre-cooling and post heating assembly (CSAFPCPHA)
Figure 11A:
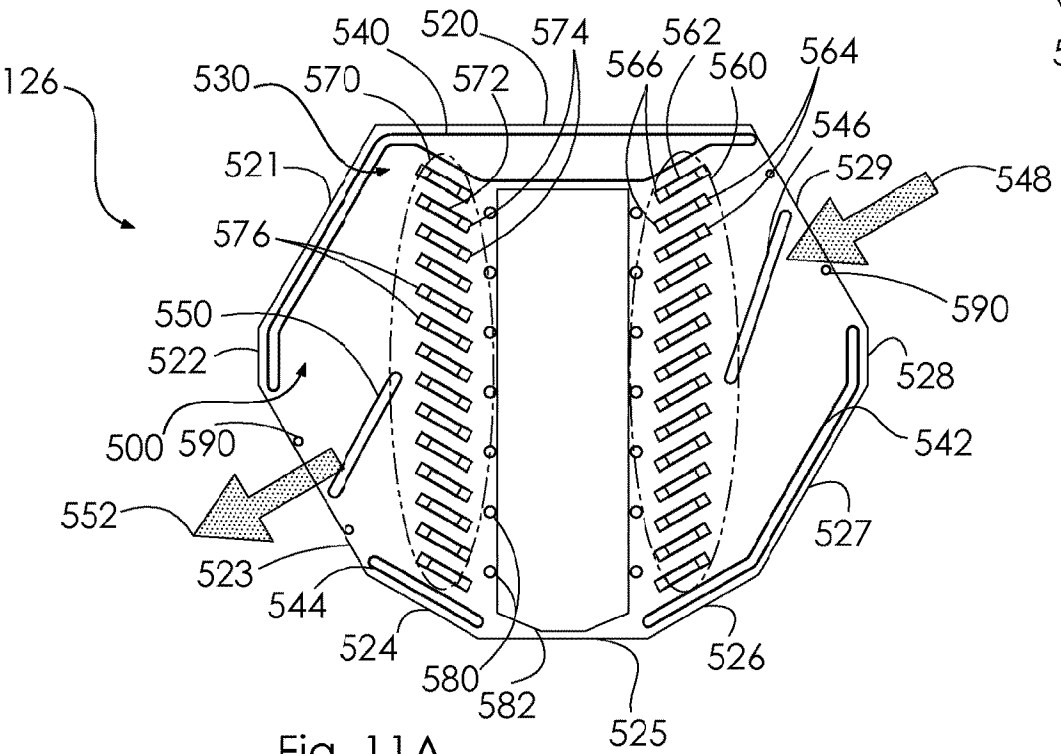
Figure 12B:
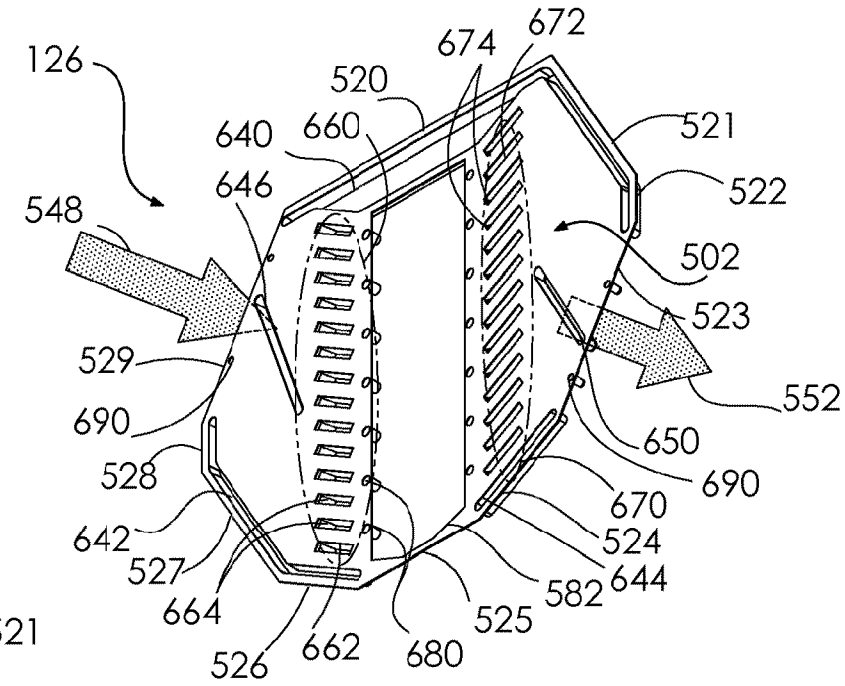
FIGS. 12A and 12B are respective simplified plan view and pictorial view illustrations of a second side of a second plate of the core-surrounding air flow pre-cooling and post heating assembly (CSAFPCPHA)
Figure 12A:
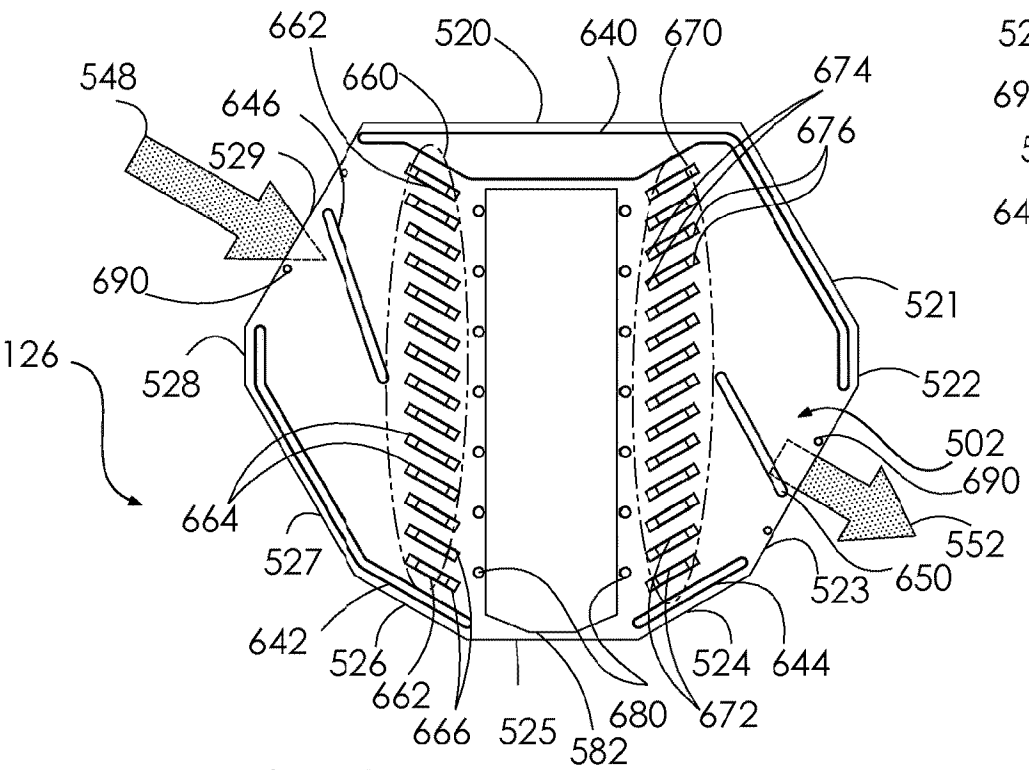

Turning now to generally planar element 126, a first side thereof, designated by reference numeral 500, is shown in FIGS. 11A and 11B and a second side thereof, designated by reference numeral 502, is shown in FIGS. 12A and 12B. Planar element 126 preferably has ten side edges, which are designated, counterclockwise with reference to FIG. 11A, by reference numerals 520, 521, 522, 523, 524, 525, 526, 527, 528 and 529. Planar element 126 is formed with a number of protrusions, which extend above the plane, designated by reference numeral 530, of planar element 126, in the sense of FIG. 11A, to a height of approximately 3 mm and which will now be described in detail. Due to manufacture of planar elements 124 and 126 by vacuum forming, there are recesses which correspond with each of the protrusions.

As seen in FIGS. 11A & 11B, first side 500 of planar element 126 includes an air flow blockage protrusion 540, which extends counterclockwise, in the sense of FIG. 11A, at first narrowly, from a location near the junction of edges 520 and 529, along and slightly spaced from edge 520 where it becomes wider and then narrows, and narrowly along and spaced from edges 521 and 522. Protrusion 540 serves to prevent air flow above plane 530 via edges 520, 521 and 522. Planar element 126 also includes an air flow blockage protrusion 542, which extends counterclockwise, in the sense of FIG. 11A, narrowly, from a location near the junction of edges 525 and 526 and along and slightly spaced from edges 526, 527 and 528. Protrusion 542 serves to prevent air flow above plane 530 via edges 526, 527 and 528. Planar element 126 also includes an air flow blockage protrusion 544, which extends along and slightly spaced from edge 524. Protrusion 544 serves to prevent air flow above plane 530 via edge 524.

Planar element 126 also includes, at first side 500, an air flow guiding protrusion 546 at what is typically an inlet region 548 above plane 530 and an air flow guiding protrusion 550 at what is typically an outlet region 552 above plane 530.

Planar element 126 also includes, at first side 500, an array 560 of mutually spaced enhanced counter flow heat exchange (ECFHE) protrusions 562 downstream of inlet region 548. Each of mutually spaced protrusions 562 preferably has a tapered inlet end 564 and a tapered outlet end 566.

Planar element 126 also includes at first side 500, an array 570 of mutually spaced enhanced counter flow heat exchange (ECFHE) protrusions 572 upstream of outlet region 552. Each of mutually spaced protrusions 572 preferably has a tapered inlet end 574 and a tapered outlet end 576.

Planar element 126 also includes, at first side 500, a plurality of mutual inner edge spacing protrusions 580 preferably arranged at the sides of a generally rectangular cutout 582 which accommodates core 102.

Planar element 126 also includes, at first side 500, a plurality of mutual outer edge spacing protrusions 590 preferably arranged along edges 523 and 529.

As seen in FIGS. 12A & 12B, second side 502 of planar element 126 includes a recess 640, which extends clockwise in the sense of FIG. 12A, at first narrowly, from a location near the junction of edges 520 and 529, along and slightly spaced from edge 520 where it becomes wider and then narrows, and narrowly along and spaced from edges 521 and 522. Planar element 126 also includes a recess 642, which extends clockwise in the sense of FIG. 12A, narrowly, from a location near the junction of edges 525 and 526 and along and slightly spaced from edges 526, 527 and 528. Planar element 126 also includes a recess 644, which extends along and slightly spaced from edge 524. Recesses 640, 642 and 644 cooperate with corresponding protrusions on planar element 124 to provide enhanced registration of the stack of interdigitated planar elements 124 and 126.

Planar element 126 also typically includes, at second side 502, a recess 646 at inlet region 548 and a recess 650 at outlet region 552.

Planar element 126 also includes, at second side 502, an array 660 of mutually spaced enhanced counter flow heat exchange (ECFHE) recesses 662 downstream of inlet region 548. Each of mutually spaced recesses 662 preferably has a tapered inlet end 664 and a tapered outlet end 666.

Planar element 126 also includes, at second side 502, an array 670 of mutually spaced enhanced counter flow heat exchange (ECFHE) recesses 672 upstream of outlet region 552. Each of mutually spaced recesses 672 preferably has a tapered inlet end 674 and a tapered outlet end 676.

Planar element 126 also includes, at second side 502, a plurality of mutual inner edge spacing recesses 680 preferably arranged at the sides of generally rectangular cutout 582 which accommodates core 102.

Planar element 126 also includes, at second side 502, a plurality of outer edge recesses 690 preferably arranged along edges 523 and 529.

Figure 13:
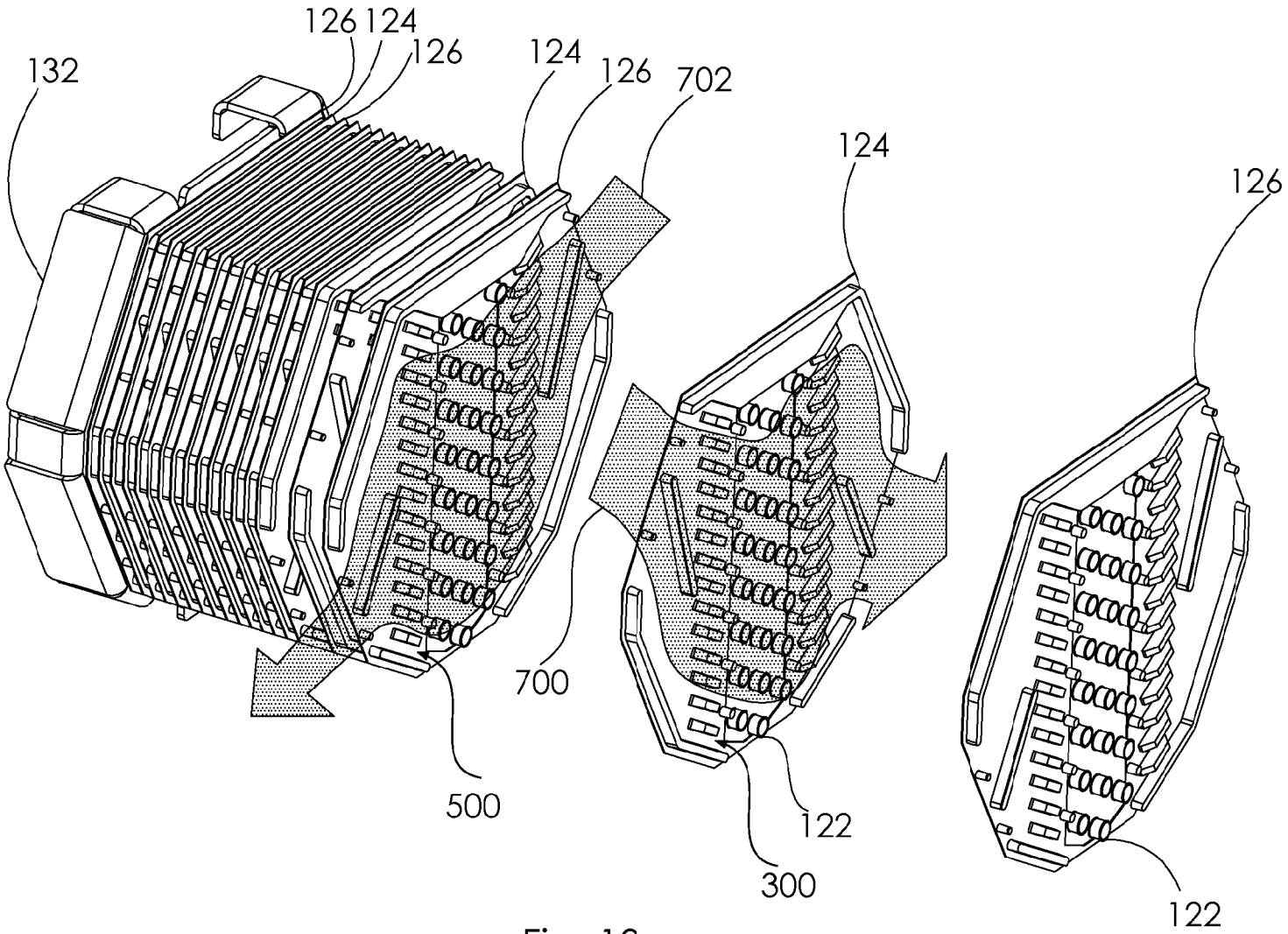
FIG. 13 is a simplified, partially exploded, pictorial illustration of part of the heat exchange assembly of FIGS. 3A and 3B, showing typical air flows between adjacent embossed generally planar elements.
Figure 14A:
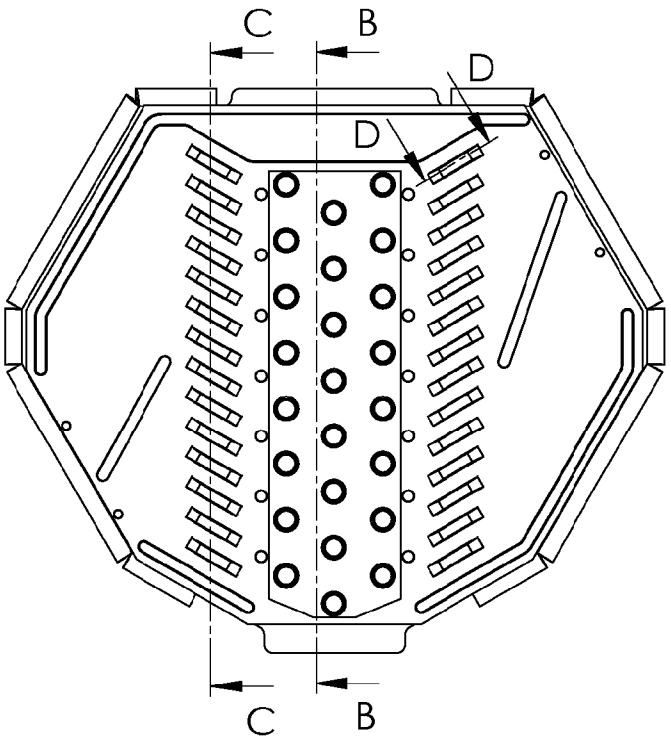
FIGS. 14A, 14B, 14C and 14D are simplified illustrations of air flow through the heat exchange assembly of FIGS. 3A and 3B, where
Figure 14D:
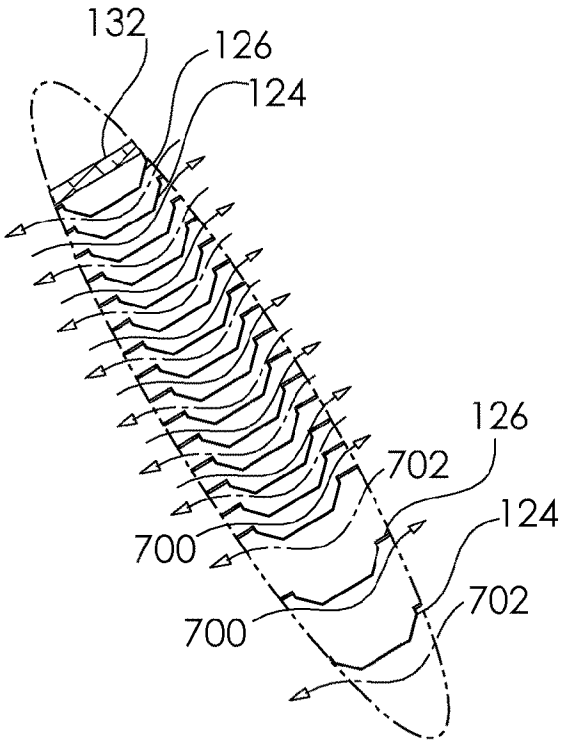
Figure 14C:
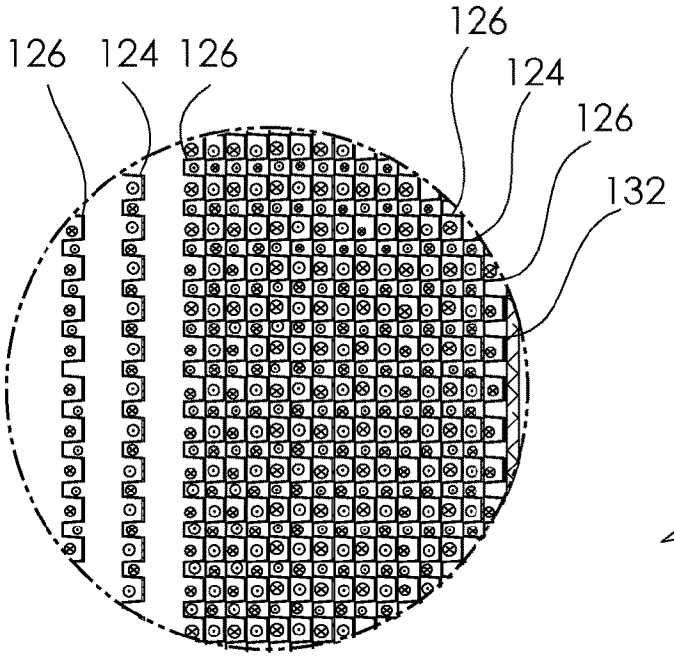
Figure 14B:
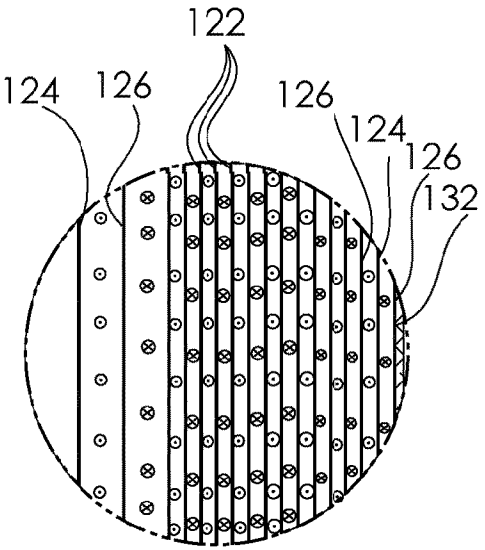

Reference is now made to FIG. 13, which is a simplified partially exploded, pictorial illustration of part of the heat exchange assembly of FIGS. 3A and 3B, showing typical air flows between adjacent embossed generally planar elements and to FIGS. 14A, 14B, 14C and 14D, which are simplified illustrations of air flow through the heat exchange assembly of FIGS. 3A and 3B, where FIG. 14A is a planar view and FIGS. 14B, 14C and 14D are sectional views taken along respective section lines B-B, C-C and D-D in FIG. 14A.

FIG. 13 shows airflow, designated generally by reference numeral 700, between a first side 300 of a planar element 124 and a second side 502 of a planar element 126. The second side 502 of planar element 126 is not seen in FIG. 13. FIG. 13 also shows airflow, designated generally by reference numeral 702, between a first side 500 of a planar element 126 and a second side 302 of a planar element 124. The second side 302 of planar element 124 is not seen in FIG. 13.

Considering airflow 700, it is seen that a relatively planar flow of typically relatively humid air enters at an inlet region 348 above the plane 330 of planar element 124, and which is bounded by adjacent second side 502 of planar element 126. This flow is guided by one or more protrusions 346 into engagement with array 360 of protrusions 362 on planar element 124 and corresponding positioned array 670 of recesses 672 of planar element 126. It is appreciated that the protrusions 362 partially seat within corresponding recesses 672 and together define an air flow passage between each recess 672 and the corresponding protrusion 362 partially seated therewithin. It is noted that the tapered ends 364 and 366 of the protrusions 362 and the tapered ends 674 and 676 of recesses 672 assist in defining these air flow passages.

Downstream of arrays 360, the air flow, which by this stage has been somewhat pre-cooled, as will be described hereinbelow, passes through the core plates 122 of core 102 in a generally planar flow, where it is substantially cooled, preferably to below the dew point. Downstream of core plates 122 of core 102, the substantially cooled air flow passes through array 370 of protrusions 372 on planar element 124 and corresponding positioned array 660 of recesses 662 on planar element 126. It is appreciated that the protrusions 372 partially seat within corresponding recesses 662 and together define an air flow passage between each recess 662 and the corresponding protrusion 372 partially seated therewithin. It is noted that the tapered ends 374 and 376 of the protrusions 372 and the tapered ends 664 and 666 of the recesses 662 assist in defining these air flow passages.

Downstream of arrays 370, the air flows, which have at this stage been somewhat warmed, as will be described hereinbelow, become joined into a relatively planar flow at outlet region 352 above the plane 330 of planar element 124, and which is bounded by adjacent second side 502 of planar element 126. This flow is guided by one or more protrusions 350.

Considering airflow 702, it is seen that a relatively planar flow of typically relatively humid air enters at an inlet region 548 above the plane 530 of planar element 126, and which is bounded by adjacent second side 302 of planar element 124. This flow is guided by one or more protrusions 546 into engagement with array 560 of protrusions 562 on planar element 126 and corresponding positioned array 470 of recesses 472 on planar element 124. It is appreciated that the protrusions 562 partially seat within corresponding recesses 472 and together define an air flow passage between each recess 472 and the corresponding protrusion 562 partially seated therewithin. It is noted that the tapered ends 564 and 566 of the protrusions 562 and the tapered ends 474 and 476 of the recesses 472 assist in defining these air flow passages.

Downstream of arrays 560, the air flow, which by this stage has been somewhat pre-cooled, as will be described hereinbelow, passes through the core plates 122 of core 102 in a generally planar flow, where it is substantially cooled, preferably to below the dew point. Downstream of core plates 122 of core 102, the substantially cooled air flow passes through array 570 of protrusions 572 on planar element 126 and corresponding positioned array 460 of recesses 462 on planar element 124. It is appreciated that the protrusions 572 partially seat within corresponding recesses 462 and together define an air flow passage between each recess 462 and the corresponding protrusion 572 partially seated therewithin. It is noted that the tapered ends 574 and 576 of the protrusions 572 and the tapered ends 464 and 466 of the recesses 462 assist in defining these air flow passages.

Downstream of arrays 570, the air flows, which have at this stage been somewhat warmed, as will be described hereinbelow, become joined into a relatively planar flow at outlet region 552 above the plane 530 of planar element 126, and which is bounded by adjacent second side 302 of planar element 124. This flow is guided by one or more protrusions 550.

Referring additionally to FIGS. 14A-14D, it is seen that the air flows 700 and 702 between adjacent partially interdigitated planar elements 124 and 126 in the stack are in a generally counter flow mutual heat exchanging relationship, notwithstanding that the air flows are not entirely parallel, particularly at their respective inlet and outlet regions. It is an important feature of the invention that the air flows 700 and 702 are generally parallel in two dimensions as they pass through the core 102 and are generally parallel in three dimensions as they pass through the air flow passages defined between the protrusions and recesses of arrays 360 and 570 respectively and as they pass through the air flow passages defined between the protrusions and recesses of arrays 370 and 560 respectively.

Thus it may be appreciated that enhanced heat exchange is provided between mutually counter airflows in the air flow passages defined between the protrusions and recesses of arrays 360 and 670 respectively and as they pass through the air flow passages defined between the protrusions and recesses of arrays 570 and 460 respectively, wherein three-dimensional counter flow is provided, and a lesser degree of heat exchange is provided therebetween in the inlet and outlet regions wherein only two-dimensional heat exchange engagement between adjacent planar air flows is provided.

This can be seen graphically from a comparison of FIGS. 14B and 14C. FIG. 14B shows a two-dimensional counter flow heat exchange relationship between adjacent generally planar air flows in the core 102 between adjacent plates 122 of the core 102.

FIG. 14C shows a three-dimensional counter flow heat exchange relationship between adjacent generally planar air flows along the flow paths defined by arrays 360 and 670. FIG. 14C also represents the three-dimensional counter flow heat exchange relationship between adjacent generally planar air flows along the flow paths defined by arrays 570 and 460.

It is appreciated that the heat exchange relationship represented in FIG. 14C is greatly enhanced as compared with that represented in FIG. 14B by virtue of the fact that nearly each flow shown in FIG. 14C is surrounded on four sides by a counterflowing flow path, whereas in FIG. 14B, nearly each planar flow is surrounded on two sides by a counterflowing flow path. It is further appreciated that the protrusions and recesses defining the flow paths are downwardly inclined so to enhance ease of draining of condensate therefrom via edges 325 and 525 into base subassembly 130 for drainage and preferably utilization as drinking water.

Realization of the highly efficient heat exchange structure shown in FIG. 14C is achieved in accordance with a particular feature of the present invention by the partial interdigitization of the protrusions and recesses described hereinabove and visualized in FIG. 14D, which shows the arrangement of these flow paths in a view taken perpendicular to the planes 330 and 530 of the respective planar elements 124 and 126.

It will be appreciated by persons skilled in the art that the present invention is not limited to what has been particularly shown and described hereinabove. Rather the scope of the invention includes both combinations and subcombinations of the various features described hereinabove as well as modifications and variations thereof which would occur to persons skilled in the art upon reading the foregoing description and which are not in the prior art.

The invention claimed is:

1. A planar element defining a plane of the planar element and adapted to form, when stacked with a plurality of other such elements, a heat exchanger, the planar element comprising:

a plurality of protrusions and corresponding recesses adapted to cooperate with respective protrusions on an adjacent planar element;

an inlet region;

a first zone;

a second zone comprising at least one cutout in the plane of the planar element, adapted to accommodate a cooling core;

a third zone;

an outlet region; and side edges;

wherein the first zone having a first set of protrusions of said plurality of protrusions adapted to direct flow from the inlet region towards the cutout of the second zone and parallel to the plane of the planar element as the flow passes through the cooling core;

the third zone having a second set of protrusions of said plurality of protrusions adapted to direct flow from the second zone towards the outlet region.

2. The planar element of claim 1 comprising at least one first guiding protrusion adapted to guide airflow within said first zone from the inlet region.

3. The planar element of claim 2 further comprising at least one second guiding protrusion adapted to guide airflow within said third zone toward the outlet region.

4. The planar element of claim 1 wherein at least one protrusion is disposed in said first zone and adapted to keep a defined gap between said planar element and a second planar element disposed adjacent to the planar element, in the inlet region.

5. The planar element of claim 1 wherein at least one protrusion is disposed in said third zone and adapted to keep a defined gap between said planar element and a second planar element disposed adjacent to said planar element, in the outlet region.

6. The planar element of claim 1 wherein at least one protrusion disposed around said cutout adapted to keep a defined gap between said planar element and a second planar element disposed adjacent to the planar element, in the cutout region.

7. The planar element of claim 1 further comprising at least a first set of parallel protrusions adapted to guide the airflow within said first region.

8. The planar element of claim 1 further comprising at least a second set of parallel protrusions adapted to guide the airflow within said third region.

9. The planar element according to claim 1 comprising an embossment selected from at least two different embossments.

10. The planar element according to claim 9 wherein the two different embossments enable the planar element to be arranged when stacked in mutually interdigitated touching relationship with each other about the cutout.

11. The planar element according to claim 9 wherein said planar element comprising protrusions on a first side cooperating with corresponding recesses on a second side of the differently embossed planar element, said planar element further comprising on a second side recesses cooperating with corresponding protrusions on a first side of the differently embossed planar element.

12. A heat exchange assembly comprising a cooling core and a core-surrounding air flow pre-cooling and post heating assembly comprising a stack of planar elements, wherein the planar elements are as defined in claim 1.

13. A heat exchange assembly according to claim 12 wherein the stack comprises differently embossed planar elements.

* * * * *